US009726992B2

(12) United States Patent
Sakuma et al.

(10) Patent No.: US 9,726,992 B2
(45) Date of Patent: Aug. 8, 2017

(54) ELECTROPHOTOGRAPHIC PHOTOSENSITIVE MEMBER, MANUFACTURING METHOD OF ELECTROPHOTOGRAPHIC PHOTOSENSITIVE MEMBER, PROCESS CARTRIDGE AND ELECTROPHOTOGRAPHIC APPARATUS

(71) Applicant: CANON KABUSHIKI KAISHA, Tokyo (JP)

(72) Inventors: Kazuko Sakuma, Suntou-gun (JP); Yuka Ishiduka, Suntou-gun (JP); Atsushi Okuda, Yokohama (JP); Kazunori Noguchi, Suntou-gun (JP); Yuki Yamamoto, Tokyo (JP); Atsushi Fujii, Yokohama (JP); Akihiro Maruyama, Mishima (JP); Nobuhiro Nakamura, Numazu (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/993,412

(22) Filed: Jan. 12, 2016

(65) Prior Publication Data

US 2016/0216618 A1 Jul. 28, 2016

(30) Foreign Application Priority Data

Jan. 26, 2015 (JP) ..... 2015-012468

(51) Int. Cl.
*G03G 5/14* (2006.01)
*G03G 5/043* (2006.01)

(52) U.S. Cl.
CPC ..... *G03G 5/0436* (2013.01)

(58) Field of Classification Search
CPC ..... G03G 5/144
See application file for complete search history.

(56) References Cited

U.S. PATENT DOCUMENTS 5,401,600 A 3/1995 Aizawa et al.
6,268,095 B1 7/2001 Kuroda et al.
6,472,514 B2 10/2002 Kuroda et al.
(Continued)

FOREIGN PATENT DOCUMENTS

JP 5-88396 A 4/1993
JP 2001-83726 A 3/2001
(Continued)

*Primary Examiner* — Hoa V Le
(74) *Attorney, Agent, or Firm* — Fitzpatrick, Cella, Harper & Scinto

(57) ABSTRACT

An electrophotographic photosensitive member comprises a support, an undercoat layer, a charge generation layer and a hole transporting layer disposed in this order. The undercoat layer contains silica particles and a polymer of a composition including an electron transporting material having a polar group selected from the group consisting of a hydroxy group, a thiol group, an amino group, a carboxy group and a methoxy group, and a cross-linking agent. The content of the electron transporting material in the composition is 30 to 70 mass % relative to the total mass of the composition and the content of the silica particles in the undercoat layer is 1 to 30 mass % relative to the total mass of the electron transporting material.

12 Claims, 1 Drawing Sheet

(56) References Cited

U.S. PATENT DOCUMENTS

| | | | | |
|---|---|---|---|---|
| 7,910,274 | B2 | 3/2011 | Tanaka et al. | |
| 8,481,236 | B2 | 7/2013 | Tanaka et al. | |
| 8,546,050 | B2 | 10/2013 | Maruyama et al. | |
| 8,795,936 | B2 | 8/2014 | Sekido et al. | |
| 8,865,381 | B2 | 10/2014 | Tanaka et al. | |
| 9,207,550 | B2 | 12/2015 | Okuda et al. | |
| 9,523,929 | B2 * | 12/2016 | Nakamura | G03G 5/076 |
| 2014/0004450 | A1 | 1/2014 | Tokimitsu et al. | |
| 2014/0377703 | A1 | 12/2014 | Ogaki et al. | |
| 2015/0185630 | A1 | 7/2015 | Ito et al. | |
| 2015/0185634 | A1 | 7/2015 | Sekiya et al. | |
| 2015/0185635 | A1 | 7/2015 | Noguchi et al. | |
| 2015/0185636 | A1 | 7/2015 | Sekiya et al. | |
| 2015/0185638 | A1 | 7/2015 | Nakamura et al. | |

FOREIGN PATENT DOCUMENTS

| | | | |
|---|---|---|---|
| JP | 2003-345044 | A | 12/2003 |
| JP | 3717320 | B2 | 11/2005 |

* cited by examiner

ELECTROPHOTOGRAPHIC PHOTOSENSITIVE MEMBER, MANUFACTURING METHOD OF ELECTROPHOTOGRAPHIC PHOTOSENSITIVE MEMBER, PROCESS CARTRIDGE AND ELECTROPHOTOGRAPHIC APPARATUS

BACKGROUND OF THE INVENTION

Field of the Invention

The present invention relates to an electrophotographic photosensitive member, a manufacturing method of electrophotographic photosensitive member, a process cartridge and an electrophotographic apparatus.

Description of the Related Art

Among electrophotographic photosensitive members, an electrophotographic photosensitive member using an organic photoconductive material has excellent film formability and can be produced by coating, with advantage of achieving an inexpensive electrophotographic photosensitive member at high productivity.

An electrophotographic photosensitive member typically includes a support and a photosensitive layer (a charge generation layer or a hole transporting layer) formed on the support. In order to suppress the charge injection from the support side to the photosensitive layer (charge generation layer) side, inhibit the generation of image defects such as fogging, and conceal the defects on the support surface, an undercoat layer is disposed between the support and the photosensitive layer.

The undercoat layer is required to attain both of extracting electrons from the charge generation layer and suppressing the charge injection from the support side to the charge generation layer side. Both of the extraction of electrons from the charge generation layer and the suppression of the charge injection are required in any environment ranging from low temperature and low humidity to high temperature and high humidity.

In Japanese Patent Application Laid-Open No. H5-88396, an undercoat layer including hydrophobic silica particles for suppression of fluctuation in properties of the undercoat layer due to environmental change is described.

Meanwhile, in Japanese Patent Application Laid-Open No. 2001-83726 and Japanese Patent Application Laid-Open No. 2003-345044, an undercoat layer including an electron transporting material, which better attains both of the extraction of electrons and the suppression of the charge injection, is described. It is presumed that the electron transporting material contained in the undercoat layer improves the extraction of electrons from the charge generation layer and the suppression of the charge injection from the support side to the photosensitive layer side, so that the sensitivity of the photosensitive member can be improved.

SUMMARY OF THE INVENTION

The present invention relates to an electrophotographic photosensitive member including: a support, an undercoat layer, a charge generation layer adjacent to the undercoat layer, and a hole transporting layer disposed in this order, the undercoat layer containing (1) silica particles and a polymer of a composition including an electron transporting material having a polar group selected from the group consisting of a hydroxy group, a thiol group, an amino group, a carboxy group and a methoxy group, and a cross-linking agent, and the content of the electron transporting material in the composition being 30 mass % or more and 70 mass % or less relative to the total mass of the composition; or (2) silica particles and an electron transporting material having a polar group selected from the group consisting of a hydroxy group, a thiol group, an amino group, a carboxy group and a methoxy group, and a binder resin, and the content of the electron transporting material in the undercoat layer being 30 mass % or more and 70 mass % or less relative to the total mass of the electron transporting material and the binder resin; and the content of the silica particles in the undercoat layer being 1 mass % or more and 30 mass % or less relative to the total mass of the electron transporting material.

Further features of the present invention will become apparent from the following description of exemplary embodiments with reference to the attached drawings.

DESCRIPTION OF THE EMBODIMENTS

Figure 1:
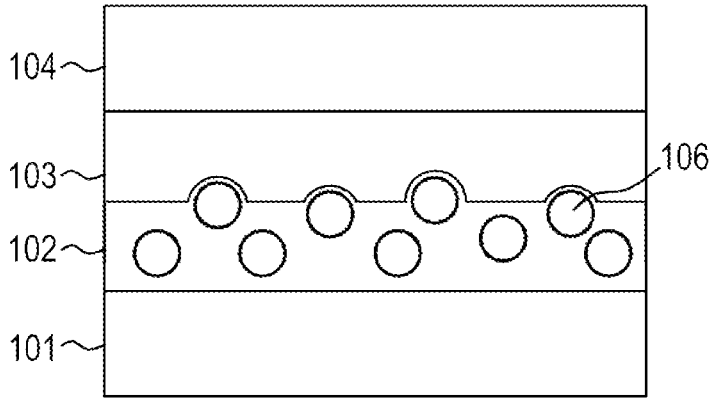
FIG. 1 is a schematic cross-sectional view for illustrating an undercoat layer.

Preferred embodiments of the present invention will now be described in detail in accordance with the accompanying drawings.

Recently, requirement for higher quality of electrophotographic images has been growing more and more, so that further improvement of sensitivity is desired.

For example, under conditions for high-speed electrophotographic process (in particular, a process speed of 200 mm/s or more), an electrophotographic photosensitive member having a higher sensitivity with enhanced effects of electron injection and electron transportation in an undercoat layer is required in order to stabilize the potential. There is still room for improvement in the sensitivity on the electrophotographic photosensitive members described in Japanese Patent Application Laid-Open No. H5-88396, Japanese Patent Application Laid-Open No. 2001-83726 and Japanese Patent Application Laid-Open No. 2003-345044.

The present invention is directed to providing an electrophotographic photosensitive member having improved sensitivity, and a method for manufacturing the electrophotographic photosensitive member. Further, the present invention is directed to providing a process cartridge and an electrophotographic apparatus having the electrophotographic photosensitive member.

The electrophotographic photosensitive member of the present invention includes: a support, an undercoat layer, a charge generation layer adjacent to the undercoat layer, and a hole transporting layer disposed in this order.

<Support>

A support having conductivity (conductive support) can be used, and examples thereof include: a support made of metal such as aluminum, nickel, copper, gold and iron, or alloy; a support including an insulating support of polyester resin, polycarbonate resin, polyimide resin or glass, on which a thin film of metal such as aluminum, silver and gold is formed or a thin film of conductive material such as indium oxide and tin oxide is formed.

The surface of a support may be subjected to an electrochemical treatment such as anodic oxidation, a wet honing treatment, a blast treatment and a machining treatment, in order to improve the electric properties and suppress interference fringes.

<Conductive Layer>

A conductive layer may be disposed between the support and the undercoat layer. The conductive layer can be obtained by forming a coating film from a coating liquid for forming a conductive layer including conductive particles dispersed in a resin on the support and then drying the coating film. Examples of the conductive particles include: carbon black, acetylene black; powder of metal such as aluminum, nickel, iron, nichrome, copper, zinc and silver; and powder of metal oxide such as conductive tin oxide and ITO.

Examples of the resin include a polyester resin, a polycarbonate resin, a polyvinyl butyral resin, an acrylic resin, a silicone resin, an epoxy resin, a melamine resin, a urethane resin, a phenol resin and an alkyd resin.

Examples of the solvent of the coating liquid for forming a conductive layer include an ether solvent, an alcohol solvent, a ketone solvent and an aromatic hydrocarbon solvent. The conductive layer has a film thickness of preferably 0.2 μm or more and 40 μm or less, more preferably 1 μm or more and 35 μm or less, furthermore preferably 5 μm or more and 30 μm or less.

<Undercoat Layer>

An undercoat layer is formed between the support or the conductive layer and the photosensitive layer.

The undercoat layer of the present invention contains silica particles and a polymer of a composition including an electron transporting material having a polar group (polymerizable functional group) selected from the group consisting of a hydroxy group, a thiol group, an amino group, a carboxy group and a methoxy group and a cross-linking agent. Alternatively the undercoat layer contains silica particles, an electron transporting material and a binder resin. In the case of containing a polymer of a composition including an electron transporting material and a cross-linking agent, the composition may further include a thermoplastic resin having a polymerizable functional group.

In the present invention, it is presumed that the sensitivity is improved by the interaction between silica particles and the electron transporting material having a polar group selected from the group consisting of a hydroxy group, a thiol group, an amino group, a carboxy group and a methoxy group.

The reason is as follows. It is presumed that the layer including silica particles and an electron transporting material having a polar group is in a state with the electron transporting material congregated around the silica particle due to the interaction of the silanol group on the surface of the silica particle and the polar group of the electron transporting material. Consequently more electron transporting materials can be present in the vicinity of the interface with the photosensitive layer in comparison with the state without silica particles, so that the electron injection capability at the interface can be improved. As a result, it is presumed that an electrophotographic photosensitive member having improved sensitivity can be obtained.

FIG. 1 is a schematic cross-sectional view for illustrating an undercoat layer of the present invention. An undercoat layer 102 is formed on a support 101, and a charge generation layer 103 is formed directly thereon. Further, a hole transporting layer 104 is formed on the charge generation layer.

The undercoat layer 102 contains a polymer of a composition including an electron transporting material having a polar group and a cross-linking agent, or an electron transporting material and a binder resin, and further contains silica particles 106.

The content of the electron transporting material is 30 mass % or more and 70 mass % or less relative to the total mass of the composition. With a content less than 30 mass %, sufficient improvement in sensitivity cannot be attained in spite of inclusion of silica particles. With a content more than 70 mass %, elution of the electron transporting material may occur in some cases.

The content of the silica particles in the undercoat layer may be 1 mass % or more and 30 mass % or less relative to the total mass of the electron transporting material, preferably in the range of 3 mass % or more and 15 mass % or less. With a content less than 1 mass %, little effect is obtained in spite of inclusion of silica particles. Conversely, with a content more than 30 mass %, the electron transporting materials unevenly distributed around the silica particle may cause a phenomenon to reduce the electron hopping efficiency between the electron transporting materials, so that the sensitivity is reduced in some cases.

In the method of forming the undercoat layer, a coating film is first formed from a coating liquid for forming an undercoat layer which contains an electron transporting material having a polar group selected from the group consisting of a hydroxy group, a thiol group, an amino group, a carboxy group, and a methoxy group, silica particles, a cross-linking agent, and, in some cases, a composition including a thermoplastic resin having a polymerizable functional group. The coating film is then dried by heating, so that the composition can be polymerized to form the undercoat layer.

The coating liquid for forming an undercoat layer in the present invention which contains an electron transporting material having a polar group, silica particles, and a thermoplastic resin may be a coating liquid for forming an undercoat layer which requires no polymerization reaction. In the case of forming such an undercoat layer, a film obtained by preparing a coating liquid, forming a coating film, and then drying the film by heating may be also used as the undercoat layer.

When the coating film from the coating liquid for forming an undercoat layer is dried by heating, the heating temperature can be 100 to 200° C.

Examples of the electron transporting material include a quinone compound, an imide compound, a benzimidazole compound and a cyclopentadienylidene compound. The electron transporting material includes at least one polar group such as a hydroxy group, a thiol group, an amino group, a carboxy group and a methoxy group. The polar group may be directly bound to a skeleton structure for transporting electrons or may be present in a side chain.

Specific examples of the electron transporting material include a compound represented by any of the following formulas (A-1) to (A-11).

(A-1)

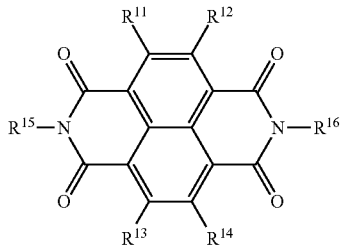

-continued (A-2)

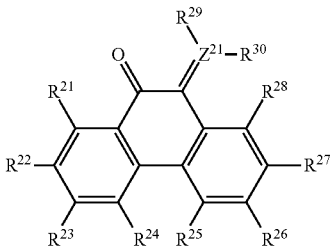

(A-3)

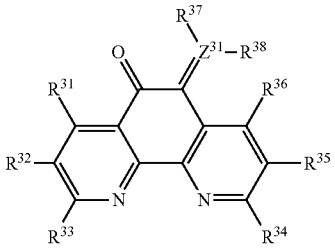

(A-4)

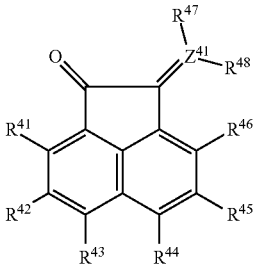

(A-5)

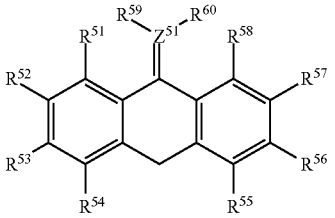

(A-6)

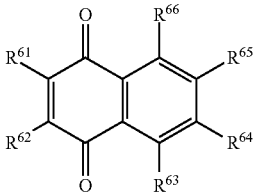

(A-7)

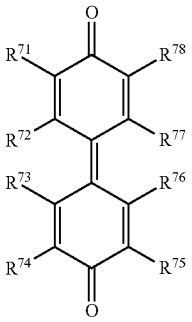

-continued (A-8)

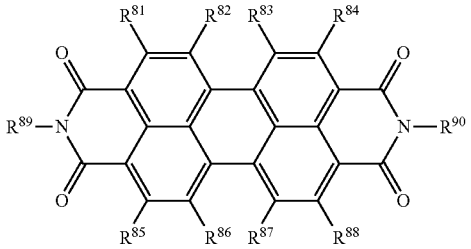

(A-9)

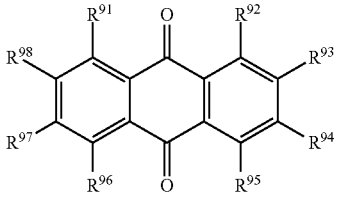

(A-11)

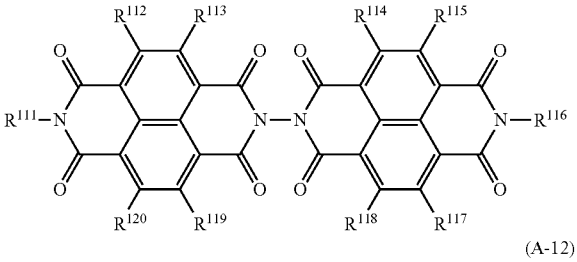

(A-12)

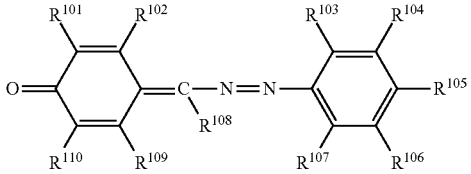

In the formulas (A-1) to (A-11), $R^{11}$ to $R^{16}$, $R^{21}$ to $R^{30}$, $R^{31}$ to $R^{38}$, $R^{41}$ to $R^{48}$, $R^{51}$ to $R^{60}$, $R^{61}$ to $R^{66}$, $R^{71}$ to $R^{78}$, $R^{81}$ to $R^{90}$, $R^{91}$ to $R^{98}$, $R^{101}$ to $R^{110}$ and $R^{111}$ to $R^{120}$ each independently represent a monovalent group as represented by the following formula (A), a hydrogen atom, a cyano group, a nitro group, a halogen atom, an alkoxycarbonyl group, a substituted or unsubstituted alkyl group, a substituted or unsubstituted aryl group, or a substituted or unsubstituted heterocyclic ring. One of the methylene groups in the main chain of an alkyl group may be substituted with O, S, NH or $NR^{121}$ ($R^{121}$: alkyl group). The substituent of a substituted alkyl group is an alkyl group, an aryl group, a halogen atom or an alkoxycarbonyl group.

The substituent of a substituted aryl group or the substituent of a substituted heterocyclic group is a halogen atom, a nitro group, a cyano group, an alkyl group, a halogen substituted alkyl group, or an alkoxy group. $Z^{21}$, $Z^{31}$, $Z^{41}$ and $Z^{51}$ each represent a carbon atom, a nitrogen atom or an oxygen atom. In the case of $Z^{21}$ of oxygen atom, $R^{29}$ and $R^{30}$ are not present. In the case of $Z^{21}$ of nitrogen atom, $R^{30}$ is not present. In the case of $Z^{31}$ of oxygen atom, $R^{37}$ and $R^{38}$ are not present. In the case of $Z^{31}$ of nitrogen atom, $R^{38}$ is not present. In the case of $Z^{41}$ of oxygen atom, $R^{47}$ and $R^{48}$ are not present. In the case of $Z^{41}$ of nitrogen atom, $R^{48}$ is not present. In the case of $Z^{51}$ of oxygen atom, $R^{59}$ and $R^{60}$ are not present. In the case of $Z^{51}$ of nitrogen atom, $R^{60}$ is not present. One of the methylene groups in the main chain of an alkylene group may be substituted with O, S or $NR^{122}$ (wherein $R^{122}$ represents a hydrogen atom or an alkyl group).

In the formulas (A-1) to (A-11), at least one of $R^{11}$ to $R^{16}$, at least one of $R^{21}$ to $R^{30}$, at least one of $R^{31}$ to $R^{38}$, at least one of $R^{41}$ to $R^{48}$, at least one of $R^{51}$ to $R^{60}$, at least one of $R^{61}$ to $R^{66}$, at least one of $R^{71}$ to $R^{78}$, at least one of $R^{81}$ to $R^{90}$, at least one of $R^{91}$ to $R^{98}$, at least one of $R^{101}$ to $R^{110}$, and at least one of $R^{111}$ to $R^{120}$ are a monovalent group represented by formula (A).

$$-(\alpha^1)_l-(\beta)_m-\gamma \quad (A)$$

In the formula (A), at least one of "$\alpha^1$", "β" and "γ" is a group having a polar group, and l and m each independently represent 0 or 1, with a sum of l and m of 0 or more and 2 or less.

Herein, "$\alpha^1$" represents a substituted or unsubstituted alkylene group having a main chain with 1 to 12 atoms, a group having a main chain with 1 to 12 atoms derived by replacing the methylene group in the main chain of a substituted or unsubstituted alkylene group with an oxygen atom, a group having a main chain with 1 to 12 atoms derived by replacing the methylene group in the main chain of a substituted or unsubstituted alkylene group with a sulfur atom, or a group having a main chain with 1 to 12 atoms derived by replacing the methylene group in the main chain of a substituted or unsubstituted alkylene group with $NR^1$.

The substituent of a substituted alkylene group is an alkyl group with 1 to 6 carbon atoms, a benzyl group, an alkoxycarbonyl group, or a phenyl group. $R^1$ represents a hydrogen atom or an alkyl group.

Herein, "β" represents a substituted or unsubstituted phenylene group, a substituted or unsubstituted cycloalkylene group, or a substituted or unsubstituted cycloalkylidene group. The substituent of the substituted phenylene group, the substituent of the substituted cycloalkylene group, or the substituent of the substituted cycloalkylidene group is an alkyl group with 1 to 6 carbon atoms, a nitro group, a halogen group, or an alkoxy group.

Herein, "γ" represents a hydrogen atom, a substituted or unsubstituted alkyl group having a main chain with 1 to 6 atoms, a group having a main chain with 1 to 6 atoms derived by replacing the methylene group in the main chain of a substituted or unsubstituted alkyl group with an oxygen atom, a group having a main chain with 1 to 6 atoms derived by replacing the methylene group in the main chain of a substituted or unsubstituted alkyl group with a sulfur atom, or a group having a main chain with 1 to 6 atoms derived by replacing the methylene group in the main chain of a substituted or unsubstituted alkyl group with $NR^2$.

The substituent of the substituted alkyl group is an alkyl group having 1 to 6 carbon atoms or an alkoxycarbonyl group. $R^2$ represents a hydrogen atom or an alkyl group.

At least two of $R^{11}$ to $R^{16}$, at least two of $R^{21}$ to $R^{30}$, at least two of $R^{31}$ to $R^{38}$, at least two of $R^{41}$ to $R^{48}$, at least two of $R^{51}$ to $R^{60}$, at least two of $R^{61}$ to $R^{66}$, at least two of $R^{71}$ to $R^{78}$, at least two of $R^{81}$ to $R^{90}$, at least two of $R^{91}$ to $R^{98}$, at least two of $R^{101}$ to $R^{110}$, and at least two of $R^{111}$ to $R^{120}$ can be a group represented by formula (A). In other words, two or more polar groups can be present in the same molecule of an electron transporting material.

The reason is that, first of all, the probability of the interaction with silanol groups present on the surface of silica particles increases.

In addition, in the case of an undercoat layer containing a polymer of a composition including an electron transporting material and a cross-linking agent, a higher effect can be expected. The polar group of an electron transporting material functions also as a polymerizable functional group so as to take part in cross-linking of the composition. With 2 or more polar groups present in the same molecule of an electron transporting material, elution of the electron transporting material into a coating liquid for forming a photosensitive layer is further suppressed when a photosensitive layer is formed on an undercoat layer by immersion coating, so that an undercoat layer having high solvent resistance can be obtained.

In the case of an electron transporting material having two or more polar groups in the same molecule, it is therefore presumed that the sensitivity of the electron transporting material can be increased by having each of a group represented by the following formula (A1) and a group represented by the following formula (A2).

$$-\alpha^2 \quad (A1)$$

$$-(\beta)_m-\gamma \quad (A2)$$

In the formulas (A1) and (A2), "$\alpha^2$" and "γ" are groups having a polar group such as a hydroxy group, a thiol group, an amino group, a carboxy group and a methoxy group.

Herein, "$\alpha^2$" represents a substituted or unsubstituted alkyl group having a main chain with 2 to 12 atoms, a group having a main chain with 2 to 12 atoms derived by replacing the methylene group in the main chain of a substituted or unsubstituted alkyl group with an oxygen atom, a group having a main chain with 2 to 12 atoms derived by replacing the methylene group in the main chain of a substituted or unsubstituted alkyl group with a sulfur atom, or a group having a main chain with 1 to 12 atoms derived by replacing the methylene group in the main chain of a substituted or unsubstituted alkyl group with $NR^3$. The substituent of the substituted alkyl group is an alkyl group having 1 to 6 carbons or an alkoxycarbonyl group, except for the case of having two or more of the substituents on one carbon atom in the main chain of the alkyl group. $R^3$ represents a hydrogen atom or an alkyl group.

In the formula (A2), "β" represents a substituted or unsubstituted phenylene group, a substituted or unsubstituted cycloalkylene group, or a substituted or unsubstituted cycloalkylidene group. The substituent of a substituted phenylene group, the substituent of a substituted cycloalkylene group, or the substituent of a cycloalkylidene group is an alkyl group having 1 to 6 carbons, a nitro group, a halogen group or an alkoxy group, and m is 0 or 1.

The definition of "γ" is different depending on the value of m in "β".

In the case of m=1, "γ" represents a hydrogen atom, a substituted or unsubstituted alkyl group having a main chain with 1 to 6 atoms, a group having a main chain with 1 to 6 atoms derived by replacing the methylene group in the main chain of a substituted or unsubstituted alkyl group with an oxygen atom, a group having a main chain with 1 to 6 atoms derived by replacing the methylene group in the main chain of a substituted or unsubstituted alkyl group with a sulfur atom, or a group having a main chain with 1 to 6 atoms derived by replacing the methylene group in the main chain of a substituted or unsubstituted alkyl group with $NR^2$. The substituent of the substituted alkyl group is an alkyl group having 1 to 6 carbons or an alkoxycarbonyl group. $R^2$ represents a hydrogen atom or an alkyl group.

In the case of m=0, "γ" represents a substituted alkyl group having a main chain with 1 to 6 atoms, a group having a main chain with 1 to 6 atoms derived by replacing the methylene group in the main chain of a substituted alkyl group with an oxygen atom, a group having a main chain with 1 to 6 atoms derived by replacing the methylene group in the main chain of a substituted alkyl group with a sulfur atom, or a group having a main chain with 1 to 6 atoms derived by replacing the methylene group in the main chain of a substituted alkyl group with $NR^2$. The substituted alkylene group has at least 2 substituents on one carbon atom in the main chain of the alkyl group, and the substituent is an alkyl group having 1 to 6 carbons or an alkoxycarbonyl group.

In the case of an electron transporting material having two polar groups in the same molecule, with one side chain structure having a group to impart flexibility to the molecular structure as described in (A1), and another side chain structure having a bulky group such as an aromatic ring, a cyclohexyl group, a tertiary alkyl group as described in (A2), the following mechanism can be presumed. The polar group in the side chain having flexibility interacts with silica particles, and the latter has lower probability for interacting with silanol groups on the surface of silica particles due to the bulkiness.

In the case of a composition including a cross-linking agent, in particular, both of the effect of association of the electron transporting materials around the silica particle and the effect of suppressing elution due to polymerization of the polar group in the electron transporting material with the cross-linking agent can be achieved at a high level. It is presumed that in addition to having the effect of improving electron injection properties at the interface due to aggregation of electron transporting materials around silica particles, variations in the hopping distance between individual molecules of the electron transporting material are reduced due to incorporation into a cross-linking structure, so that a higher sensitivity can be obtained.

Specific examples of the electron transporting material are as follows. In Tables 1 to 11, groups represented by formula (A) (groups having a polar group) are described as A and Aa. Aa is represented by the similar structural formula as A, and the specific examples of the monovalent group thereof are described in the column of A and Aa. In the Tables, "γ" described as represents a hydrogen atom, and the hydrogen atom as "γ" is included in the structure described in the column of "$\alpha^1$" or "β".

In the following Tables, in the case of corresponding "$\alpha^1$" and "$\alpha^2$" described in the formulas (A) and (Aa), the respective ones are described in the column of "α" in parallel for simplification of the Tables.

In Table 1, examples of the electron transporting material having groups represented by formulas (A1) and (A2) include A113 to A118, and two side chains A and Aa represent (A1) and (A2), respectively. In particular, a classification is made for (A2)=Aa as follows:

In the case of m=0, (A2)=Aa represents A113 and A115 having "γ" with two or more substituents for one carbon.

In the case of m=1, (A2)=Aa has a substituted phenylene group such as A114 and A118, a cyclohexylene group such as A116, or a cyclohexylidene group such as A117.

TABLE 1

| Exemplary compound | $R^{11}$ | $R^{12}$ | $R^{13}$ | $R^{14}$ | $R^{15}$ | $R^{16}$ | A | | |
|---|---|---|---|---|---|---|---|---|---|
| | | | | | | | α | β | γ |
| A101 | H | H | H | H | R | A | 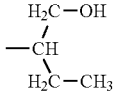 | — | — |
| A102 | H | H | H | H | R | A | — | 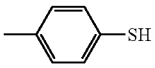 | — |
| A103 | H | H | H | H | R | A | 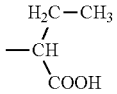 | — | — |
| A104 | H | H | H | H | R | A | — | 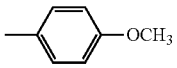 | — |
| A105 | H | H | H | H | R | A | 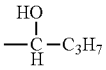 | — | — |
| A106 | H | H | H | H | R | A | 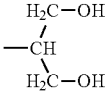 | — | — |
| A107 | H | H | H | H | R | A | 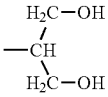 | — | — |
| A108 | H | H | H | H | A | A | 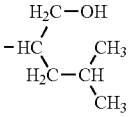 | — | — |

TABLE 1-continued
| | | | | | | | | | |
|---|---|---|---|---|---|---|---|---|---|
| A109 | H | H | H | H | A | Aa | 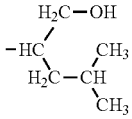 | — | — |
| A110 | H | H | H | H | A | A | — | — | —OH |
| A111 | H | H | H | H | A | Aa | 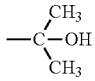 | — | — |
| A112 | H | H | H | H | A | A | $—C_3H_6—OH$ | — | — |
| A113 | H | H | H | H | A | A | $—C_3H_6—OH$ | — | — |
| A114 | H | H | H | H | A | Aa | 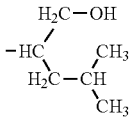 | — | — |
| A115 | H | H | H | H | A | Aa | 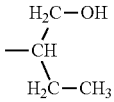 | — | — |
| A116 | H | H | H | Aa | A | H | — | $—C_2H_4—NH_2$ | — |
| A117 | H | H | H | H | A | Aa | 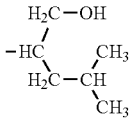 | — | — |
| A118 | H | H | H | H | A | Aa | 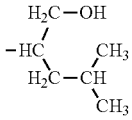 | — | — |
| Exemplary compound | Aa | | | |
|---|---|---|---|---|
| | α | β | γ | R |
| A101 | — | — | — | 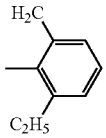 |
| A102 | — | — | — | 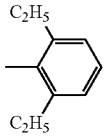 |
| A103 | — | — | — | 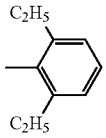 |
| A104 | — | — | — | 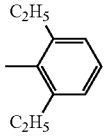 |

TABLE 1-continued
| | | | | |
|---|---|---|---|---|
| A105 | — | — | — | 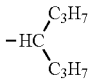 |
| A106 | — | — | — | 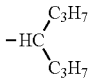 |
| A107 | — | — | — | 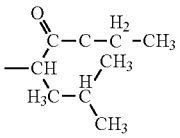 |
| A108 | — | — | — | — |
| A109 | $—C_2H_4—S—C_2H_4—OH$ | — | — | — |
| A110 | — | — | — | — |
| A111 | 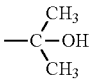 | — | — | — |
| A112 | — | — | — | — |
| A113 | 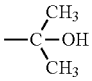 | — | — | — |
| A114 | — | 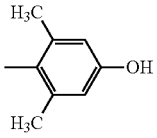 | — | — |
| A115 | 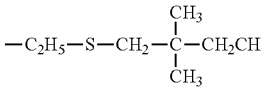 | — | — | — |
| A116 | — | 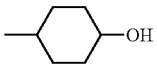 | — | — |
| A117 | — | 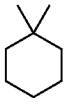 | 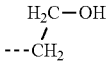 | — |
| A118 | — | 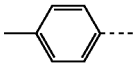 | $—C_2H_4—OH$ | — |
TABLE 2
| Exemplary compound | $R^{21}$ | $R^{22}$ | $R^{23}$ | $R^{24}$ | $R^{25}$ | $R^{26}$ | $R^{27}$ | $R^{28}$ | $R^{29}$ | $R^{30}$ | $Z^{21}$ | A α | A β | A γ | Aa α | Aa β | Aa γ | R |
|---|---|---|---|---|---|---|---|---|---|---|---|---|---|---|---|---|---|---|
| A201 | H | H | A | H | H | H | H | H | — | — | O | — | 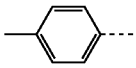 | $---CH_2—OH$ | — | — | — | — |
| A202 | H | H | H | H | H | H | H | H | A | — | N | — | 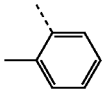 | 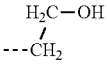 | — | — | — | — |

TABLE 2-continued

| Exemplary compound | $R^{21}$ | $R^{22}$ | $R^{23}$ | $R^{24}$ | $R^{25}$ | $R^{26}$ | $R^{27}$ | $R^{28}$ | $R^{29}$ | $R^{30}$ | $Z^{21}$ | A α | A β | A γ | Aa α | Aa β | Aa γ | R |
|---|---|---|---|---|---|---|---|---|---|---|---|---|---|---|---|---|---|---|
| A203 | H | H | R | H | R | H | H | H | A | — | N | — | 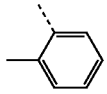 | $H_2C-OH$ / ---$CH_2$ | — | — | — | 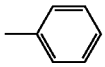 |
| A204 | H | H | R | H | R | H | H | H | A | — | N | — | 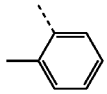 | $H_2C-OH$ / ---$CH_2$ | — | — | — | 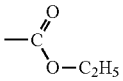 |
| A205 | H | H | A | H | A | H | H | H | — | — | O | — | 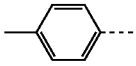 | ---$CH_2-OH$ | — | — | — | — |
| A206 | H | A | H | H | H | A | H | H | — | — | O | — | 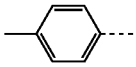 | ---$CH_2-OH$ | — | — | — | — |
| A207 | H | A | H | H | H | H | Aa | H | — | — | O | — | 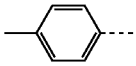 | ---$CH_2-OH$ | $H_2C-OH$ / —CH \ $H_2C-CH_3$ | — | — | — |

TABLE 3

| Exemplary compound | $R^{31}$ | $R^{32}$ | $R^{33}$ | $R^{34}$ | $R^{35}$ | $R^{36}$ | $R^{37}$ | $R^{38}$ | $Z^{31}$ | A α | A β | A γ | Aa α | Aa β | Aa γ |
|---|---|---|---|---|---|---|---|---|---|---|---|---|---|---|---|
| A301 | H | A | H | H | H | H | — | — | O | — | 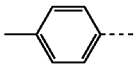 | ---$CH_2-OH$ | — | — | — |
| A302 | H | H | H | H | H | H | A | — | N | — | 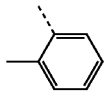 | $H_2C-OH$ / ---$CH_2$ | — | — | — |
| A303 | H | H | H | H | H | H | A | — | N | $H_2C-OH$ / —CH \ $H_2C-CH_3$ | 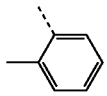 | $H_2C-OH$ / ---$CH_2$ | — | — | — |
| A304 | H | H | Cl | Cl | H | H | A | — | N | — | 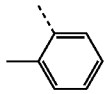 | $H_2C-OH$ / ---$CH_2$ | — | — | — |
| A305 | H | A | H | H | A | H | CN | CN | C | — | 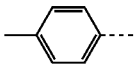 | ---$CH_2-OH$ | — | — | — |
| A306 | H | A | H | H | Aa | H | — | — | O | — | 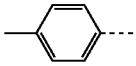 | ---$CH_2-OH$ | $H_2C-OH$ / —HC \ $H_2C-CH_3$ | — | — |

TABLE 4

| Exemplary compound | $R^{41}$ | $R^{42}$ | $R^{43}$ | $R^{44}$ | $R^{45}$ | $R^{46}$ | $R^{47}$ | $R^{48}$ | $Z^{41}$ | A α | A β | A γ | Aa α | Aa β | Aa γ |
|---|---|---|---|---|---|---|---|---|---|---|---|---|---|---|---|
| A401 | H | H | A | H | H | H | CN | CN | C | — | 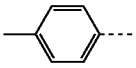 | ---$CH_2-OH$ | — | — | — |

TABLE 4-continued

| Exemplary compound | $R^{41}$ | $R^{42}$ | $R^{43}$ | $R^{44}$ | $R^{45}$ | $R^{46}$ | $R^{47}$ | $R^{48}$ | $Z^{41}$ | A α | A β | A γ | Aa α | Aa β | Aa γ |
|---|---|---|---|---|---|---|---|---|---|---|---|---|---|---|---|
| A402 | H | H | H | H | H | H | A | — | N | — | 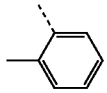 | $H_2C-OH$ / ---$CH_2$ | — | — | — |
| A403 | H | H | A | A | H | H | CN | CN | C | — | 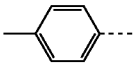 | ---$CH_2-OH$ | — | — | — |
| A404 | H | H | A | A | H | H | CN | CN | C | — | 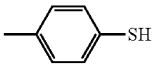 SH | — | — | — | — |
| A405 | H | H | A | A | H | H | — | — | O | — | 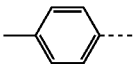 | ---$CH_2-OH$ | — | — | — |
| A406 | H | H | A | H | H | H | Aa | — | N | — | 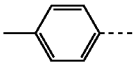 | $H_2C-OH$ / ---$CH_2$ | $H_2C-OH$ / —CH \ $H_2C-CH_3$ | — | — |

TABLE 5

| Exemplary compound | $R^{51}$ | $R^{52}$ | $R^{53}$ | $R^{54}$ | $R^{55}$ | $R^{56}$ | $R^{57}$ | $R^{58}$ | $R^{59}$ | $R^{60}$ | $Z^{51}$ | A α | A β | A γ | Aa α | Aa β | Aa γ |
|---|---|---|---|---|---|---|---|---|---|---|---|---|---|---|---|---|---|
| A501 | H | A | H | H | H | H | H | H | CN | CN | C | — | 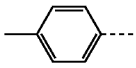 | ---$CH_2-OH$ | — | — | — |
| A502 | H | $NO_2$ | H | H | $NO_2$ | H | $NO_2$ | H | A | — | N | — | 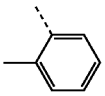 | $H_2C-OH$ / ---$CH_2$ | — | — | — |
| A503 | H | A | H | H | H | H | A | H | CN | CN | C | $H_2C-OH$ / —CH \ $H_2C-CH_3$ | — | — | — | — | — |
| A504 | H | H | A | H | H | A | H | H | CN | CN | C | — | 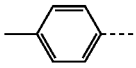 | ---$CH_2-OH$ | — | — | — |
| A505 | H | H | Aa | H | H | H | H | H | A | — | N | — | 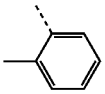 | $H_2C-OH$ / ---$CH_2$ | $H_2C-OH$ / —CH \ $H_2C-CH_3$ | — | — |

TABLE 6

| Exemplary compound | $R^{61}$ | $R^{62}$ | $R^{63}$ | $R^{64}$ | $R^{65}$ | $R^{66}$ | A α | A β | A γ | Aa α | Aa β | Aa γ |
|---|---|---|---|---|---|---|---|---|---|---|---|---|
| A601 | A | H | H | H | H | H | — | 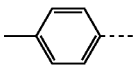 | ---$CH_2-OH$ | — | — | — |
| A602 | A | H | H | H | H | H | — | 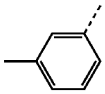 | $H_2C-OH$ / ---$CH_2$ | — | — | — |

TABLE 6-continued

| Exemplary compound | $R^{61}$ | $R^{62}$ | $R^{63}$ | $R^{64}$ | $R^{65}$ | $R^{66}$ | A α | A β | A γ | Aa α | Aa β | Aa γ |
|---|---|---|---|---|---|---|---|---|---|---|---|---|
| A603 | A | H | H | H | H | H | $H_2C-OH$ / $-CH$ \ $H_2C-CH_3$ | — | — | — | — | — |
| A604 | A | A | H | H | H | H | — | 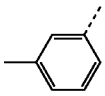 | $---CH_2-OH$ | — | — | — |
| A605 | A | A | H | H | H | H | $H_2C-OH$ / $-CH$ \ $H_2C-CH_3$ | — | — | — | — | — |
| A606 | A | Aa | H | H | H | H | — | 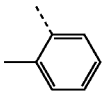 | $H_2C-OH$ / $---CH_2$ | $H_2C-OH$ / $-CH$ \ $H_2C-CH_3$ | — | — |

TABLE 7

| Exemplary compound | $R^{71}$ | $R^{72}$ | $R^{73}$ | $R^{74}$ | $R^{75}$ | $R^{76}$ | $R^{77}$ | $R^{78}$ | A α | A β | A γ | Aa α | Aa β | Aa γ |
|---|---|---|---|---|---|---|---|---|---|---|---|---|---|---|
| A701 | A | H | H | H | H | H | H | H | — | 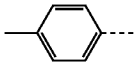 | $---CH_2-OH$ | — | — | — |
| A702 | A | H | H | H | H | H | H | H | $H_2C-OH$ / $-CH$ \ $H_2C-CH_3$ | — | — | — | — | — |
| A703 | A | H | H | H | A | H | H | H | — | 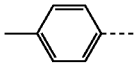 | $---CH_2-OH$ | — | — | — |
| A704 | A | H | H | H | Aa | H | H | H | $H_2C-OH$ / $-CH$ \ $H_2C-CH_3$ | — | — | — | 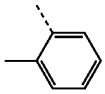 | $---CH_2-OH$ |
| A705 | A | H | H | H | Aa | H | H | H | — | 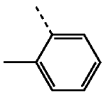 | $---CH_2-OH$ | $-(CH_2)_5-OH$ | — | — |

TABLE 8

| Exemplary compound | $R^{81}$ | $R^{82}$ | $R^{83}$ | $R^{84}$ | $R^{85}$ | $R^{86}$ | $R^{87}$ | $R^{88}$ | $R^{89}$ | $R^{90}$ | A α | A β | A γ | Aa α | Aa β | Aa γ | R |
|---|---|---|---|---|---|---|---|---|---|---|---|---|---|---|---|---|---|
| A801 | H | H | H | H | H | H | H | H | R | A | $H_2C-OH$ / $-CH$ \ $H_2C-CH_3$ | — | — | — | — | — | 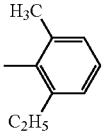 |
| A802 | H | H | H | H | H | H | H | H | R | A | $H_2C-OH$ / $-CH$ \ $COOH$ | — | — | — | — | — | 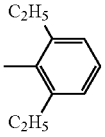 |

TABLE 8-continued

| Exemplary compound | $R^{81}$ | $R^{82}$ | $R^{83}$ | $R^{84}$ | $R^{85}$ | $R^{86}$ | $R^{87}$ | $R^{88}$ | $R^{89}$ | $R^{90}$ | A α | A β | A γ | Aa α | Aa β | Aa γ | R |
|---|---|---|---|---|---|---|---|---|---|---|---|---|---|---|---|---|---|
| A803 | H | CN | H | H | H | H | CN | H | R | A | $H_2C-OH$ / —CH \ $H_2C-CH_3$ | — | — | — | — | — | $H_3C$ / $C_2H_5$ |
| A804 | H | H | H | H | H | H | H | H | A | A | $H_2C-OH$ / —CH \ $H_2C-CH_3$ | — | — | — | — | — | — |
| A805 | H | H | H | H | H | H | H | H | A | A | — | — | $H_2C-OH$ / ---$CH_2$ | — | — | — | — |
| A806 | H | H | H | H | H | H | H | H | A | Aa | — | — | $H_2C-OH$ / ---$CH_2$ | $H_2C-OH$ / —CH \ $H_2C-CH_3$ | — | — | — |

TABLE 9

| Exemplary compound | $R^{91}$ | $R^{92}$ | $R^{93}$ | $R^{94}$ | $R^{95}$ | $R^{96}$ | $R^{97}$ | $R^{98}$ | A α | A β | A γ | Aa α | Aa β | Aa γ |
|---|---|---|---|---|---|---|---|---|---|---|---|---|---|---|
| A901 | A | H | H | H | H | H | H | H | ---$CH_2-OH$ | — | — | — | — | — |
| A902 | A | H | H | H | H | H | H | H | —$C_2H_4$—OH | — | — | — | — | — |
| A903 | H | H | H | H | H | H | H | A | ---$CH_2-OH$ | — | — | — | — | — |
| A904 | H | H | H | H | H | H | H | A | —$C_2H_4$—OH | — | — | — | — | — |
| A905 | H | CN | H | H | H | H | CN | A | — | —$OCH_3$ | — | — | — | — |
| A906 | A | A | H | $NO_2$ | H | H | $NO_2$ | H | —$C_2H_4$—OH | — | — | — | — | — |
| A907 | H | A | A | H | H | H | H | H | ---$CH_2-OH$ | — | — | — | — | — |
| A908 | H | H | A | H | H | H | Aa | H | — | —--- | ---$CH_2-OH$ | —$C_2H_4$—OH | — | — |

TABLE 10

| Exemplary compound | $R^{101}$ | $R^{102}$ | $R^{103}$ | $R^{104}$ | $R^{105}$ | $R^{106}$ | $R^{107}$ | $R^{108}$ | $R^{109}$ | $R^{110}$ |
|---|---|---|---|---|---|---|---|---|---|---|
| A1001 | R | H | H | H | A | H | H | H | H | R |
| A1002 | R | H | H | H | A | H | H | H | H | R |
| A1003 | R | H | H | H | A | H | H | H | H | R |
| A1004 | R | H | H | H | A | H | H | H | H | R |

TABLE 10-continued
| | | | | | | | | | | |
|---|---|---|---|---|---|---|---|---|---|---|
| A1005 | R | H | H | H | A | H | H | H | H | R |
| A1006 | A | H | H | H | A | H | H | H | H | Aa |
| Exemplary compound | A α | A β | A γ | Aa α | Aa β | Aa γ | R |
|---|---|---|---|---|---|---|---|
| A1001 | —$CH_2$—OH | — | — | — | — | — | 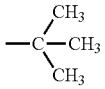 |
| A1002 | — | 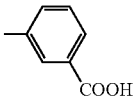 | — | — | — | — | 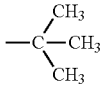 |
| A1003 | — | 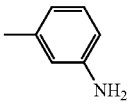 | — | — | — | — | 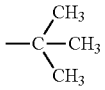 |
| A1004 | — | 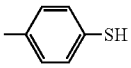 | — | — | — | — | 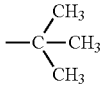 |
| A1005 | —$CH_2$—OH | — | — | — | — | — | 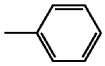 |
| A1006 | — | 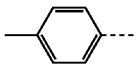 | —$CH_2$—OH | —$C_2H_4$—OH | — | — | — |
TABLE 11
| Exemplary compound | $R^{111}$ | $R^{112}$ | $R^{113}$ | $R^{114}$ | $R^{115}$ | $R^{116}$ | $R^{117}$ | $R^{118}$ | $R^{119}$ | $R^{120}$ |
|---|---|---|---|---|---|---|---|---|---|---|
| A1101 | A | H | H | H | H | A | H | H | H | H |
| A1102 | A | H | H | H | H | A | H | H | H | H |
| A1103 | A | H | H | H | H | A | H | H | H | H |
| A1104 | A | H | H | H | H | R | H | H | H | H |
| A1105 | A | H | H | H | H | R | H | H | H | H |
| A1106 | A | H | H | H | H | Aa | H | H | H | H |
| Exemplary compound | A α | A β | A γ | Aa α | Aa β | Aa γ | R |
|---|---|---|---|---|---|---|---|
| A1101 | 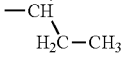 | — | — | — | — | — | — |
| A1102 | 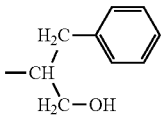 | — | — | — | — | — | — |
| A1103 | — | 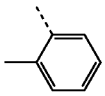 | —$C_2H_4$—OH | — | — | — | — |
| A1104 | 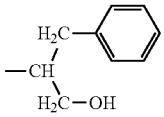 | — | — | — | — | — | 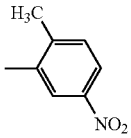 |

TABLE 11-continued

| | | | | | | | |
|---|---|---|---|---|---|---|---|
| A1105 | $H_2C-OH$ / $-CH$ \ $H_2C-CH_3$ | — | — | — | — | — | $C_2H_5$ / $C_2H_5$ |
| A1106 | — | | $-C_2H_4-OH$ | $H_2C-OH$ / $-CH$ \ $H_2C-CH_3$ | — | — | — |

A derivative (derivative of electron transporting material) having a structure selected from the group consisting of (A-2) to (A-6) and (A-9) is purchasable from Tokyo Chemical Industry Co., Ltd., Sigma-Aldrich Japan K.K., or Johnson Matthey Japan Incorporated. A derivative having a structure (A-1) can be synthesized from a reaction between a naphthalene tetracarboxylic dianhydride purchasable from Tokyo Chemical Industry Co., Ltd. or Johnson Matthey Japan Incorporated and a monoamine derivative. A derivative having a structure (A-7) can be synthesized from a raw material phenol derivative purchasable from Tokyo Chemical Industry Co., Ltd. or Sigma-Aldrich Japan K.K. A derivative having a structure (A-8) can be synthesized by a reaction between a perylene tetracarboxylic dianhydride purchasable from Tokyo Chemical Industry Co., Ltd. or Sigma-Aldrich Japan K.K. and a monoamine derivative. A derivative having a structure (A-10) can be synthesized, for example, by oxidizing a phenol derivative having a hydrazone structure in an organic solvent with a proper oxidizing agent such as potassium permanganate through a known method described in Japanese Patent No. 3717320. A derivative having a structure (A-11) can be synthesized from a reaction among a naphthalene tetracarboxylic dianhydride purchasable from Tokyo Chemical Industry Co., Ltd., Sigma-Aldrich Japan K.K., or Johnson Matthey Japan Incorporated, a monoamine derivative, and hydrazine.

The compound represented by any one of (A-1) to (A-11) includes a polar group (a hydroxy group, a thiol group, an amino group, a carboxy group, or a methoxy group) which is polymerizable with a cross-linking agent. Examples of the method for synthesizing a compound represented by any one of (A-1) to (A-11) through introduction of a polar group into a derivative having one of the structures (A-1) to (A-11) include the following methods. A method includes synthesizing a derivative having, for example, any one of the structures (A-1) to (A-11), and then directly introducing a polar group. Another method includes introducing a structure having a polar group or a functional group which can be the precursor of a polar group. The latter method includes performing a cross-coupling reaction of a halide derivative having any one of the structures (A-1) to (A-11) with use of, for example, a palladium catalyst and a base, so as to introduce an aryl group having a functional group. Further, a method for introducing an alkyl group having a functional group includes performing a cross-coupling reaction of a halide derivative having any one of the structures (A-1) to (A-11) with use of a $FeCl_3$ catalyst and a base. Further, a method for introducing a hydroxyalkyl group and a carboxyl group includes lithiating a halide derivative having any one of the structures (A-1) to (A-11), and then reacting with an epoxy compound and $CO_2$.

Subsequently, the cross-linking agent is described below.

As the cross-linking agent, a compound polymerizable with or cross-linkable with an electron transporting material having a polar group (polymerizable functional group) and a thermoplastic resin having a polymerizable functional group can be used. More specifically, compounds described in "Cross-linking Agent Handbook" by Shinzo Yamashita and Tosuke Kaneko, published by Taiseisha, Co. (1981) and the like can be used.

The cross-linking agent for use in the undercoat layer can be an isocyanate compound or an amine compound. The isocyanate compound can have 2 to 6 isocyanate groups or block isocyanate groups. Examples include, besides benzene triisocyanate, methylbenzene triisocyanate, triphenylmethane triisocyanate and lysine triisocyanate, an isocyanurate modified product of diisocyanate such as tolylene diisocyanate, hexamethylene diisocyanate, dicyclohexylmethane diisocyanate, naphthalene diisocyanate, diphenylmehtane diisocyanate, isophorone diisocyanate, xylylene diisocyanate, 2,2,4-trimethylhexamethylene diisocyanate, methyl-2,6-diisocyanate hexanoate, and norbornane diisocyanate, a biuret modified product, an allophanate modified product, and an adduct modified product of trimethylolpropane or pentaerythritol. In particular, an isocyanurate modified product and an adduct modified product are more preferred.

A block isocyanate group is a group having a structure of $-NHCOX^1$ ($X^1$: protective group). The $X^1$ can be any protective group as long as capable of being introduced into an isocyanate group, and groups represented by the following formulas (H1) to (H6) are more preferred.

(H1)

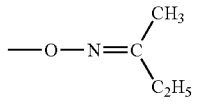

(H2)

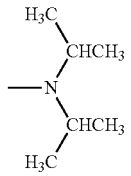

(H3)

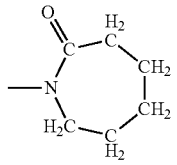

-continued
(H4)
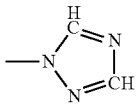
(H5)
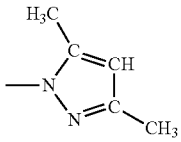
(H6)
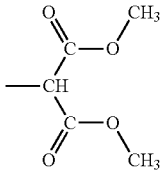
Specific examples (B1) to (B21) of the isocyanate compound are as follows.
(B1)
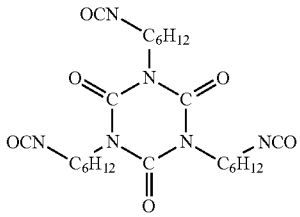
(B2)
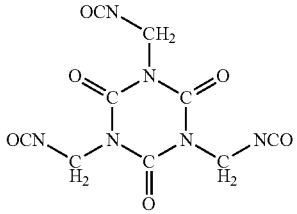
(B3)
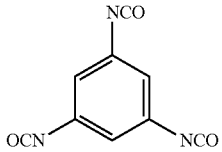
(B4)
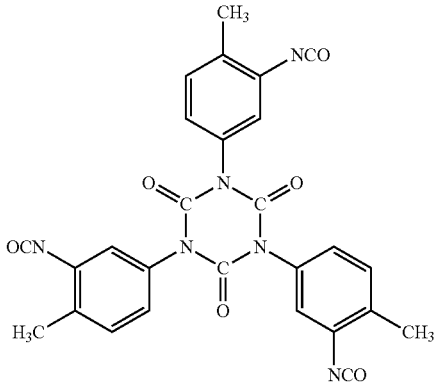
-continued
(B5)
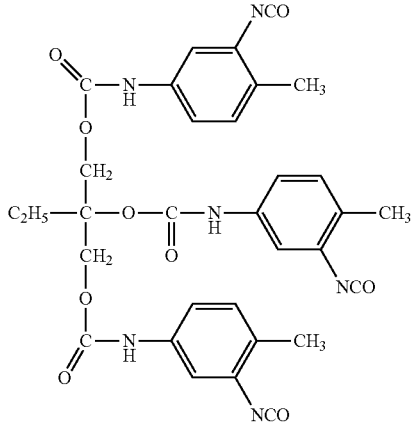
(B6)
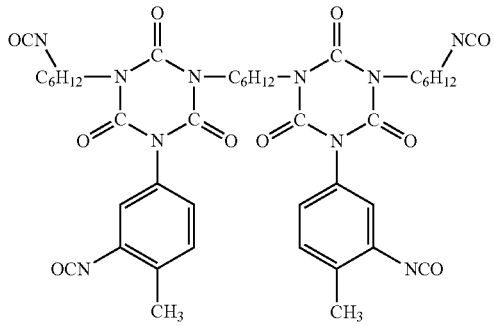
(B7)
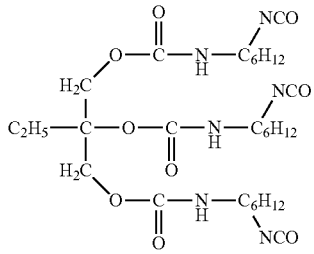
(B8)
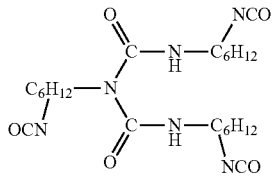
(B9)
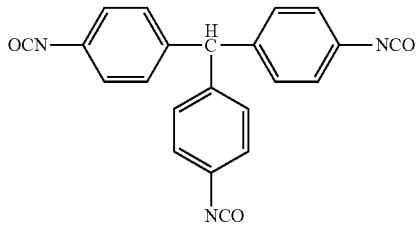

-continued
(B10)
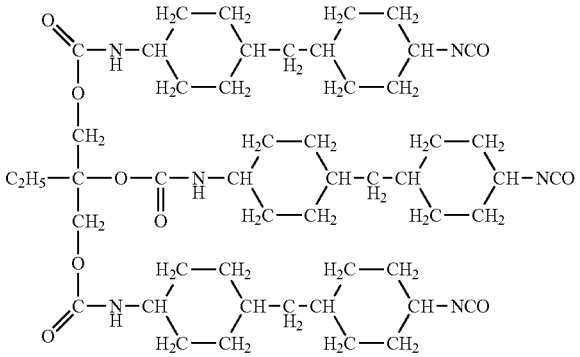
(B11)
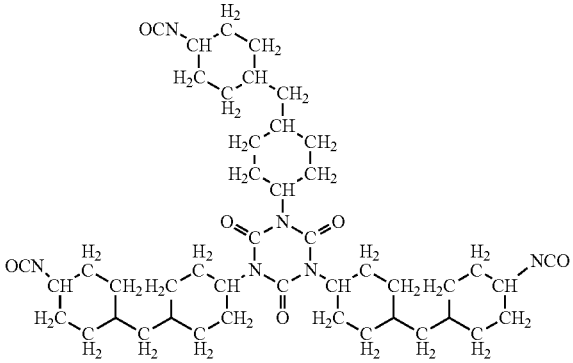
(B12)
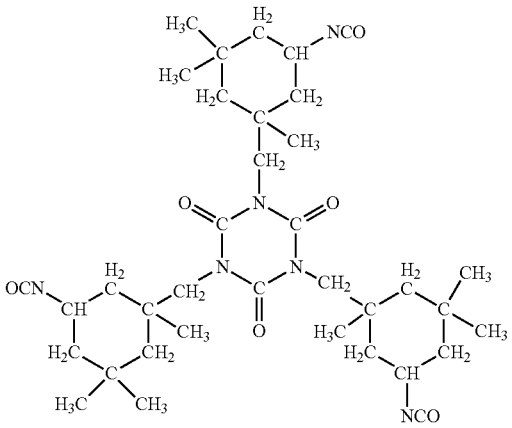
(B13)
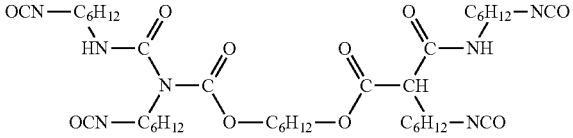
-continued
(B14)
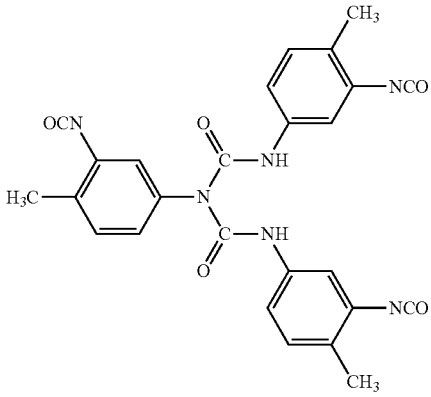
(B15)
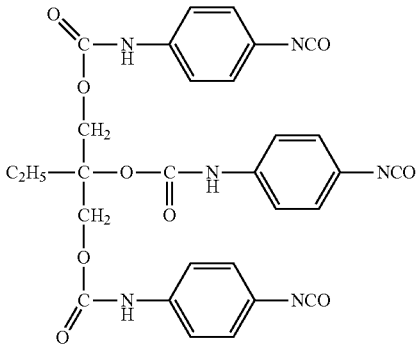
(B16)
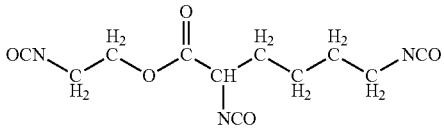
(B17)
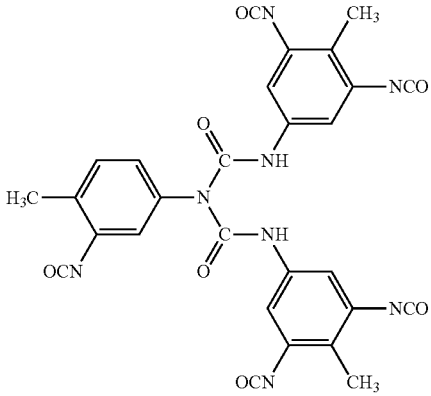

-continued (B18)

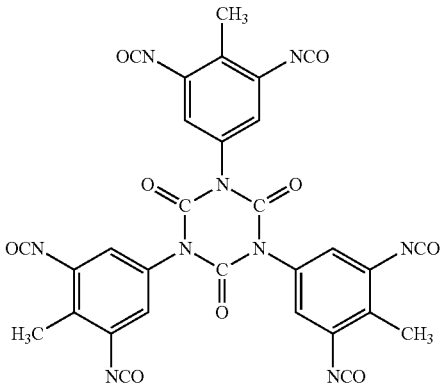

(B19)

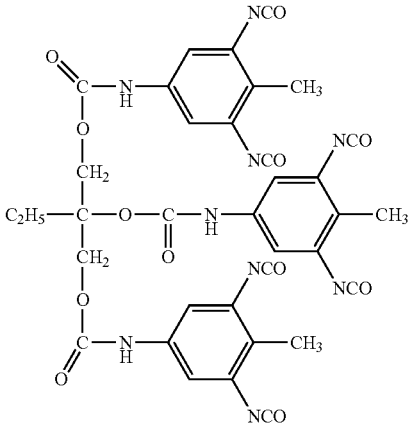

(B20)

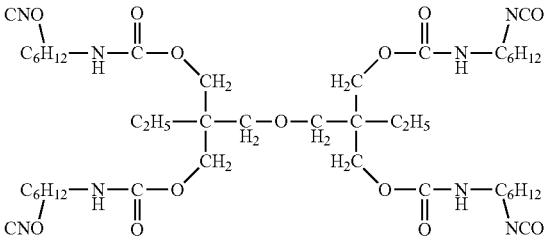

(B21)

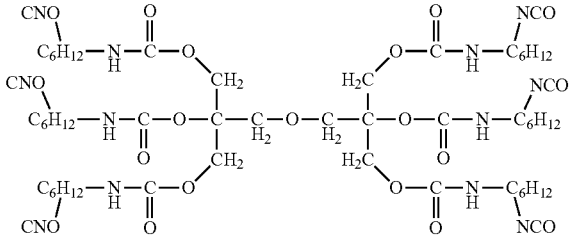

The amine compound can be, for example, an amine compound having a plurality of (two or more) N-methylol groups or alkyl etherified N-methylol groups. Examples of the amine compound include a melamine compound, a guanamine compound and a urea compound. More specifically the amine compound can be a compound represented by any of the following formulas (C1) to (C5), or an oligomer of the compound represented by any of the following formulas (C1) to (C5).

(C1)

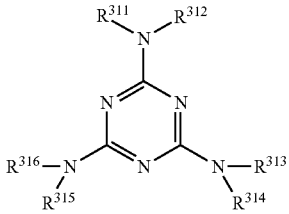

(C2)

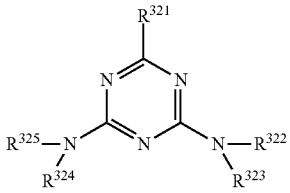

(C3)

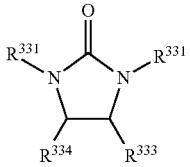

(C4)

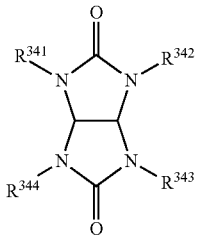

(C5)

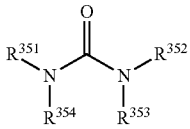

In the formulas (C1) to (C5), $R^{311}$ to $R^{316}$, $R^{322}$ to $R^{325}$, $R^{331}$ to $R^{334}$, $R^{341}$ to $R^{344}$, and $R^{351}$ to $R^{354}$ each independently represent a hydrogen atom, a hydroxy group, an acyl group, or a monovalent group represented by $—CH_2—OR^4$, and at least one of $R^{311}$ to $R^{316}$, at least one of $R^{322}$ to $R^{325}$, at least one of $R^{331}$ to $R^{334}$, at least one of $R^{341}$ to $R^{344}$, and at least one of $R^{351}$ to $R^{354}$ are the monovalent group represented by $—CH_2—OR^4$. $R^4$ represents a hydrogen atom or an alkyl group having 1 or more and 10 or less carbon atoms. The alkyl group can be a methyl group, an ethyl group, a propyl group (n-propyl group and isopropyl group), a butyl group (n-butyl group, isobutyl group and tert-butyl group), etc. from the viewpoint of polymerization properties. $R^{321}$ represents an aryl group, an alkyl group-substituted aryl group, a cycloalkyl group or an alkyl group-substituted cycloalkyl group.

A multimer of the compound represented by any one of the formulas (C1) to (C5) may be contained. From the viewpoint of obtaining a film of uniform polymer, 10 mass % or more of the compound (monomer) represented by any of the formulas (C1) to (C5) can be contained relative to the total mass of the amine compound.

The multimer can have a polymerization degree of 2 or more and 100 or less. A plurality of the multimers and the monomers may be mixed for use.

Examples of the compound represented by the formula (C1) which is typically purchasable include SUPER MELAMI No. 90 (manufactured by NOF Corporation), SUPER BECKAMINE (R) TD-139-60, L-105-60, L127-60, L110-60, J-820- and G-821-60 (manufactured by DIC Corporation), UBAN 2020 (manufactured by Mitsui Chemicals Inc.), SUMITEX RESIN M-3 (manufactured by Sumitomo Chemical Co., Ltd.), and NIKALAC MW-30, MW-390, and MX-750LM (manufactured by Nippon Carbide Industries Co., Inc.). Examples of the compound represented by the formula (C2) which is typically purchasable include SUPER BECKAMINE (R) L-148-55, 13-535, L-145-60 and TD-126 (manufactured by DIC Corporation), and NIKALAC BL-60, and BX-4000 (manufactured by Nippon Carbide Industries Co., Inc.). Examples of the compound represented by the formula (C3) which is typically purchasable include NIKALAC MX-280 (manufactured by Nippon Carbide Industries Co., Inc.). Examples of the compound represented by the formula (C4) which is typically purchasable include NIKALAC MX-270 (manufactured by Nippon Carbide Industries Co., Inc.). Examples of the compound represented by the formula (C5) which is typically purchasable include NIKALAC MX-290 (manufactured by Nippon Carbide Industries Co., Inc.).

Subsequently the thermoplastic resin having a polymerizable functional group is described below. The thermoplastic resin can have a structural unit represented by the following formula (D).

(D)

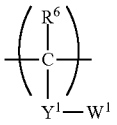

In the formula (D), $R^6$ represents a hydrogen atom or an alkyl group. $Y^1$ represents a single bond, an alkylene group or a phenylene group. $W^1$ represents a hydroxy group, a thiol group, an amino group, a carboxyl group or a methoxy group.

Examples of the resin having a structural unit represented by the formula (D) include an acetal resin, a polyolefin resin, a polyester resin, a polyether resin and a polyamide resin. The structural unit represented by the formula (D) may be contained in the following characteristic structure or except in the characteristic structure. The following (E-1) to (E-6) represent the characteristic structures. The (E-1) is the structural unit of an acetal resin. The (E-2) is the structural unit of a polyolefin resin. The (E-3) is a structural unit of a polyester resin. The (E-4) is a structural unit of a polyether resin. The (E-5) is a structural unit of a polyamide resin. The (E-6) is a structural unit of a cellulose resin.

(E-1)

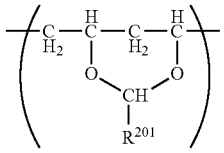

(E-2)

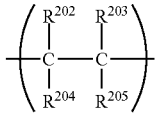

(E-3)

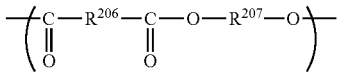

(E-4)

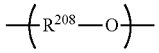

(E-5)

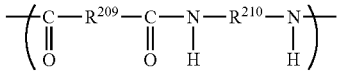

(E-6)

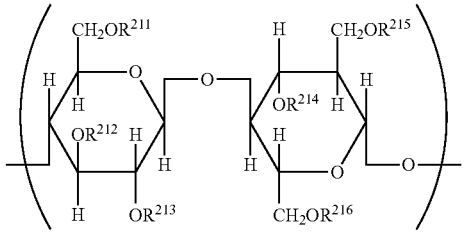

In the formulas, $R^{201}$ to $R^{205}$ each independently represent a substituted or unsubstituted alkyl group or a substituted or unsubstituted aryl group, and $R^{206}$ to $R^{210}$ each independently represent a substituted or unsubstituted alkylene group or a substituted or unsubstituted arylene group. In the case of $R^{201}$ of $C_3H_7$ (propyl group), butyral is represented. $R^{211}$ to $R^{216}$ represent an acetyl group, a hydroxyethyl group, a hydroxypropyl group, or a hydrogen group.

The resin having a structural unit represented by the formula (D) (hereinafter referred to as resin D) can be obtained by, for example, polymerization of a monomer having a polymerizable functional group (a hydroxy group, a thiol group, an amino group, a carboxyl group or a methoxy group) which is purchasable from Sigma-Aldrich Japan K.K., or Tokyo Chemical Industry Co., Ltd. Specific examples of the structure represented by the formula (D) are described in the following Table 12.

TABLE 12

| | Structure | | | Number of moles of functional | Characteristic | | Molecular |
|---|---|---|---|---|---|---|---|
| | $R^6$ | $Y^1$ | $W^1$ | group per g | site | Substituent at characteristic site | weight |
| D1 | H | Single bond | OH | 3.3 mmol | Butyral | $R^{201} = C_3H_7$ | $1 \times 10^5$ |
| D2 | H | Single bond | OH | 3.3 mmol | Butyral | $R^{201} = C_3H_7$ | $4 \times 10^4$ |
| D3 | H | Single bond | OH | 3.3 mmol | Butyral | $R^{201} = C_3H_7$ | $2 \times 10^4$ |
| D4 | H | Single bond | OH | 1.0 mmol | Polyolefin | $R^{202}$ to $R^{205}$ = H | $1 \times 10^5$ |
| D5 | H | Single bond | OH | 3.0 mmol | Polyester | $R^{206} = R^{207} = C_2H_4$ | $8 \times 10^4$ |

TABLE 12-continued

| | Structure | | | Number of moles of functional | Characteristic | | Molecular |
|---|---|---|---|---|---|---|---|
| | $R^6$ | $Y^1$ | $W^1$ | group per g | site | Substituent at characteristic site | weight |
| D6 | H | Single bond | OH | 2.5 mmol | Polyether | $R^{208} = C_4H_8$ | $5 \times 10^4$ |
| D7 | H | Single bond | OH | 2.1 mmol | Polyether | $R^{208} = C_4H_8$ | $2 \times 10^5$ |
| D8 | H | Single bond | COOH | 3.5 mmol | Polyolefin | $R^{202}$ to $R^{205}$ = H | $6 \times 10^4$ |
| D9 | H | Single bond | $NH_2$ | 1.2 mmol | Polyamide | $R^{209} = C_{10}H_{20}$, $R^{210} = C_6H_{12}$ | $2 \times 10^5$ |
| D10 | H | Single bond | SH | 1.3 mmol | Polyolefin | $R^{202}$ to $R^{205}$ = H | $9 \times 10^3$ |
| D11 | H | Phenylene | OH | 2.8 mmol | Polyolefin | $R^{202}$ to $R^{205}$ = H | $4 \times 10^3$ |
| D12 | H | Single bond | OH | 3.0 mmol | Butyral | $R^{201} = C_3H_7$ | $7 \times 10^4$ |
| D13 | H | Single bond | OH | 2.9 mmol | Polyester | $R^{206}$ = Ph, $R^{207} = C_2H_4$ | $2 \times 10^4$ |
| D14 | H | Single bond | OH | 2.5 mmol | Polyester | $R^{206} = R^{207} = C_2H_4$ | $6 \times 10^3$ |
| D15 | H | Single bond | OH | 2.7 mmol | Polyester | $R^{206} = R^{207} = C_2H_4$ | $8 \times 10^4$ |
| D16 | H | Single bond | COOH | 1.4 mmol | Polyolefin | $R^{202}$ to $R^{204}$ = H, $R^{205} = CH_3$ | $2 \times 10^5$ |
| D17 | H | Single bond | COOH | 2.2 mmol | Polyester | $R^{206}$ = Ph, $R^{207} = C_2H_4$ | $9 \times 10^3$ |
| D18 | H | Single bond | COOH | 2.8 mmol | Polyester | $R^{206} = R^{207} = C_2H_4$ | $8 \times 10^2$ |
| D19 | $CH_3$ | $CH_2$ | OH | 1.5 mmol | Polyester | $R^{206} = R^{207} = C_2H_4$ | $2 \times 10^4$ |
| D20 | $C_2H_5$ | $CH_2$ | OH | 2.1 mmol | Polyester | $R^{206} = R^{207} = C_2H_4$ | $1 \times 10^4$ |
| D21 | $C_2H_5$ | $CH_2$ | OH | 3.0 mmol | Polyester | $R^{206} = R^{207} = C_2H_4$ | $5 \times 10^4$ |
| D22 | H | Single bond | $OCH_3$ | 2.8 mmol | Polyolefin | $R^{202}$ to $R^{205}$ = H | $7 \times 10^3$ |
| D23 | H | Single bond | OH | 3.3 mmol | Butyral | $R^{201} = C_3H_7$ | $2.7 \times 10^5$ |
| D24 | H | Single bond | OH | 3.3 mmol | Butyral | $R^{201} = C_3H_7$ | $4 \times 10^5$ |
| D25 | H | Single bond | OH | 2.5 mmol | Acetal | $R^{201}$ = H | $3.4 \times 10^5$ |
| D26 | H | Single bond | OH | 2.8 mmol | Cellulose | $R^{211} = R^{216}$ = COCH3, $R^{212}$ to $R^{215}$ = H | $3 \times 10^4$ |

Examples of the resin having the structural unit represented by the formula (D) which is purchasable include as follows: a polyether polyol resin such as AQD-457 and AQD-473 manufactured by Nippon Polyurethane Industry Co., Ltd., and SANNIX GP-400 and GP-700 manufactured by Sanyokasei Co., Ltd; a polyester polyol resin such as PHTHALKYD W2343 manufactured by Hitachi Chemical Co., Ltd., WATERSOL S-118 and CD-520 manufactured by DIC Corporation, and HARIDIP WH-1188 manufactured by Harima Chemicals Group, Inc.; a polyacrylic polyol resin such as BURNOCK WE-300 and WE-304 manufactured by DIC Corporation; a polyvinyl alcohol resin such as KURARAY POVAL PVA-203 manufactured by Kuraray Co., Ltd.; a polyvinyl acetal resin such as KW-1, KW-3, BX-1, BM-1, KS-1, KS-3 and KS-5Z manufactured by Sekisui Chemical Co., Ltd.; a polyamide resin such as Toresin FS-350 manufactured by Nagase ChemteX Corporation; a carboxyl group-containing resin such as AQUALIC manufactured by Nippon Shokubai Co., Ltd. and FINELEX SG2000 manufactured by Namariichi Co., Ltd.; a polyamine resin such as LUCKAMIDE manufactured by DIC Corporation; and a polythiol resin such as QE-340M manufactured by Toray Industries, Inc.

The resin D can have a weight average molecular weight (Mw) in the range of 5000 to 400000.

Examples of the method for determining the quantity of the polymerizable functional group in a resin include the titration of carboxyl group with use of potassium hydroxide, the titration of amino group with use of sodium nitrite, the titration of hydroxyl group with use of acetic anhydride and potassium hydroxide, and the titration of thiol group with use of 5,5'-dithiobis(2-nitrobenzoic acid). Examples thereof further include a method using a calibration curve obtained from IR spectra of samples with various introduction ratio of the polymerizable functional group.

In the case of using a resin with a cross-linking agent, a catalyst may be contained in order to accelerate the polymerization. Examples of the catalyst include dibutyltin dilaurate, an amine catalyst and a metal soap.

In the case of using a binder resin in the undercoat layer, specific examples of the binder resin include an acetal resin, a polyolefin resin, a polyester resin, a polyether resin, a polyamide resin, a polycarbonate resin and a polyurethane resin.

Although the undercoat layer of the present invention may be formed of any one of a cross-linking agent and a resin, the highest sensitivity can be achieved by the combination use of a cross-linking agent and a resin from the viewpoint of film formability.

Examples of the solvent for use in the coating liquid for forming an undercoat layer include an alcohol solvent, a sulfoxide solvent, a ketone solvent, an ether solvent, an ester solvent and an aromatic hydrocarbon solvent.

The undercoat layer may further contain organic fine particles, inorganic fine particles, a levelling agent, etc., other than the polymer in order to improve the film formability and the electric properties of the undercoat layer. The content thereof in the undercoat layer, however, is preferably less than 50 mass %, more preferably less than 20 mass %, relative to the total mass of the undercoat layer.

In addition, between the support and the undercoat layer or between the undercoat layer and the photosensitive layer, another layer such as a second undercoat layer containing no polymer of the present invention may be disposed.

Subsequently, the silica particles contained in the undercoat layer are described as follows.

The type of silica particles for use in the present invention is not particularly limited. The silica particles may be obtained by any one of a wet method such as a sol-gel method and a water glass method and a dry method such as a gas phase method.

When added, the silica particles may be in a powder form or may be dispersed in a solvent so as to form a slurry.

The silica particles can have a hydrophobicity of 40% or less in methanol titration testing. With a hydrophobicity of 40% or less, the higher effect of improving the sensitivity can be achieved. The value of hydrophobicity reflects the amount of silanol groups on the surface. The value of hydrophobicity increases with decrease of the amount of silanol groups on the surface.

The hydrophobicity of silica particles can be measured by a methanol titration method using a powder wettability tester WET-100P (manufactured by Rhesca Corporation) as described below.

First, 0.05 g of silica particles of which the hydrophobicity is to be measured are floated on the surface of 60 ml of ion-exchanged water. Subsequently, while the silica particles are dispersed at an agitation speed of 300 rpm, methanol is dropped into the dispersion liquid at a drop rate of 2.5 ml/min. Then, the dropping amount of methanol is obtained when the transmittance is reduced by 30%. The hydrophobicity is obtained by the following formula (a). The transmittance is obtained by the following formula (b). The initial transmitted light intensity represents the transmitted light intensity prior to the dropping of methanol.

$$\text{Hydrophobicity}=(\text{dropping amount of methanol})/(\text{dropping amount of methanol}+60) \quad \text{Formula (a)}$$

$$\text{Transmittance}(\%)=(\text{transmitted light intensity})/(\text{initial transmitted light intensity})\times 100 \quad \text{Formula (b)}$$

As the value of hydrophobicity of silica particles decreases, the more functional groups having compatibility with water are present on the surface of silica particles.

The silica particles of the present invention has an average primary particle diameter of preferably 10 nm or more and 2000 nm or less, more preferably 10 nm or more and 500 nm or less. Within the range, the improvement of sensitivity and the effect of suppressing electric charge injection into the charge generation layer are enhanced.

The Silica particles may be subjected to surface treatment within the range not to inhibit the effect of the present invention. More specifically, it is only required that a proper amount of silanol groups or any groups having interaction with the polar group of an electron transporting material remain on the surface of the silica particle. Even when subjected to surface treatment, higher effect of increasing sensitivity can be expected as long as the value of hydrophobicity to reflect the silanol residues is lower than 40%.

Various composite oxide particles such as silica and alumina may be used.

Examples of the method for dispersing silica particle powder include a method using a homogenizer, an ultrasonic wave disperser, a ball mill, a sand mill, a roll mill or a vibration mill.

The undercoat layer has a film thickness of preferably 0.5 μm or more and 15 μm or less, more preferably 0.5 μm or more and 5 μm or less.

<Charge Generation Layer>

A charge generation layer is disposed immediately above the undercoat layer.

Examples of the charge generation material include an azo pigment, a perylene pigment, an anthraquinone derivative, an anthanthrone derivative, a dibenzpyrene quinone derivative, a pyranthrone derivative, a violanthrone derivative, an isoviolanthrone derivative, an indigo derivative, a thioindigo derivative, a phthalocyanine pigment such as a metal phthalocyanine and a non-metal phthalocyanine and a bisbenzimidazole derivative. In particular, at least one of an azo pigment and a phthalocyanine pigment is preferred. Among the phthalocyanine pigments, oxy-titanium phthalocyanine, chlorogallium phthalocyanine, and hydroxygallium phthalocyanine are preferred.

Preferred examples of the oxy-titanium phthalocyanine include an oxy-titanium phthalocyanine crystal with a crystal form having peaks at Bragg angles (2θ±0.2°) of 9.0°, 14.2°, 23.9° and 27.1° in CuKα characteristic X-ray diffraction, and an oxy-titanium phthalocyanine crystal with a crystal form having peaks at Bragg angles)(2θ±0.2° of 9.5°, 9.7°, 11.7°, 15.0°, 23.5°, 24.1° and 27.3°.

Preferred examples of the hydroxygallium phthalocyanine include a hydroxygallium phthalocyanine crystal with a crystal form having peaks at Bragg angles) (2θ±0.2° of 7.3°, 24.9° and 28.1° in CuKα characteristic X-ray diffraction, and a hydroxygallium phthalocyanine crystal with a crystal form having peaks at Bragg angles) (2θ±0.2° of 7.5°, 9.9°, 12.5°, 16.3°, 18.6°, 25.1° and 28.3°.

Examples of the binder resin for use in the charge generating layer include polymers and copolymers of vinyl compounds such as styrene, vinyl acetate, vinyl chloride, an acrylic ester, a methacrylate, vinylidene fluoride and trifluoroethylene, a polyvinyl alcohol resin, a polyvinyl acetal resin, a polycarbonate resin, a polyester resin, a polysulfone resin, a polyphenylene oxide resin, a polyurethane resin, a cellulosic resin, a phenol resin, a melamine resin, a silicon resin and an epoxy resin. In particular, a polyester resin, a polycarbonate resin and a polyvinyl acetal resin are preferred, and a polyvinyl acetal resin is more preferred.

In the charge generation layer, the mass ratio of the charge generation material to the binder resin (charge generation material/binder resin) is preferably in the range of 10/1 to 1/10, more preferably in the range of 5/1 to 1/5. Examples of the solvent for use in the coating liquid for forming a charge generation layer include an alcohol solvent, a sulfoxide solvent, a ketone solvent, an ether solvent, an ester solvent and an aromatic hydrocarbon solvent.

The charge generation layer can have a film thickness of 0.05 μm or more and 5 μm or less.

<Hole Transporting Layer>

A hole transporting layer is formed on the charge generation layer.

Examples of the hole transporting material include a polycyclic aromatic compound, a hetero ring compound, a hydrazone compound, a styryl compound, a benzidine compound, a triarylamine compound, triphenylamine, and a polymer having a group derived from the above-described compounds on the main chain or side chain. In particular, a triarylamine compound, a benzidine compound and a styryl compound are preferred.

Examples of the binder rein for use in the hole transporting layer include a polyester resin, a polycarbonate resin, a polymethacrylate resin, a polyarylate resin, a polysulfone resin and a polystyrene resin. In particular, a polycarbonate resin and a polyarylate resin are preferred. The weight average molecular weight (Mw) thereof can be in the range of 10,000 to 300,000.

In the hole transporting layer, the mass ratio of the hole transporting material to the binder resin (hole transporting material/binder resin) is preferably in the range of 10/5 to 5/10, more preferably in the range of 10/8 to 6/10.

The hole transporting layer can have a film thickness of 3 μm or more and 40 μm or less, more preferably 5 μm or more and 16 μm or less, considering the film thickness of the undercoat layer. Examples of the solvent for use in the coating liquid for forming a hole transporting layer include an alcohol solvent, a sulfoxide solvent, a ketone solvent, an ether solvent, an ester solvent and an aromatic hydrocarbon solvent.

A protective layer may be formed on the hole transporting layer. The protective layer contains conductive particles or a charge transporting material and a binder resin. The protective layer may further contain an additive such as a lubricant.

The binder resin itself of the protective layer may have conductive properties and charge transporting properties. In that case, the protective layer needs not to contain conductive particles and a charge transporting material other than the resin. The binder resin of the protective layer may be a thermoplastic resin or a hardening resin to be polymerized by heat, light, radiation (e.g. electron beams) or the like.

A method for forming the individual layers such as a conductive layer, an undercoat layer, a charge generation layer and a hole transporting layer to constitute an electrophotographic photosensitive member includes first dissolving and/or dispersing materials to constitute the individual layers in a solvent so as to obtain coating liquids, each of which is applied to form a coating film. Subsequently, each of the resulting coating films is dried and/or hardened to form a layer. Examples of the method of applying the coating liquid include a dip coating method (immersion coating method), a spray coating method, a curtain coating method and a spin coating method. In particular, a dip coating method is preferred from the viewpoints of efficiency and productivity.

The method for manufacturing an electrophotographic photosensitive member according to the present invention has a feature comprising the step of forming a coating film from a coating liquid for forming an undercoat layer containing (1) silica particles and a composition comprising an electron transporting material having a polar group selected from the group consisting of a hydroxy group, a thiol group, an amino group, a carboxy group and a methoxy group, and a cross-linking agent, wherein a content of the electron transporting material in the composition is 30 mass % or more and 70 mass % or less relative to the total mass of the composition and a content of the silica particles in the coating liquid for forming an undercoat layer is 1 mass % or more and 30 mass % or less relative to the total mass of the electron transporting material; or (2) silica particles and an electron transporting material comprising a polar group selected from the group consisting of a hydroxy group, a thiol group, an amino group, a carboxy group and a methoxy group, and a binder resin, wherein a content of the electron transporting material in the coating liquid for forming an undercoat layer is 30 mass % or more and 70 mass % or less relative to the total mass of the electron transporting material and the binder resin and a content of the silica particles in the coating liquid for forming an undercoat layer is 1 mass % or more and 30 mass % or less relative to the total mass of the electron transporting material; and the step of forming undercoat layer by heating and drying the coating film.

<Process Cartridge and Electrophotographic Apparatus>

Figure 2:
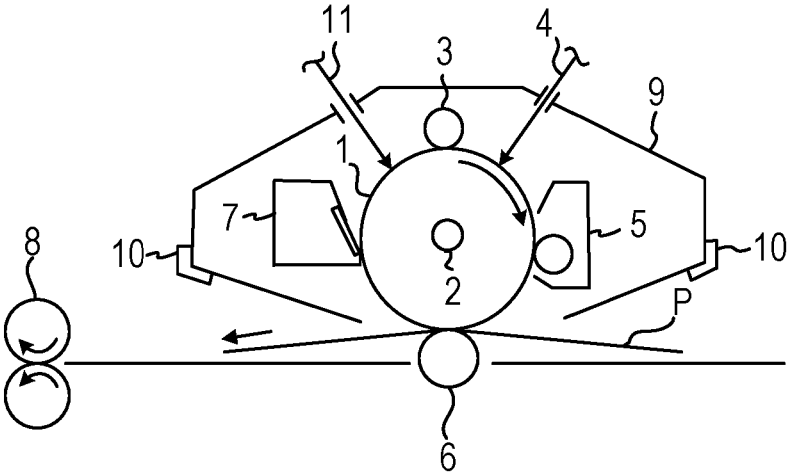
FIG. 2 is a schematic cross-sectional view of an electrophotographic apparatus having a process cartridge equipped with an electrophotographic photosensitive member.

In FIG. 2, a schematic structure of an electrophotographic apparatus having a process cartridge equipped with an electrophotographic photosensitive member is illustrated.

In FIG. 2, a cylindrical electrophotographic member 1 is rotation driven at a predetermined circumferential speed in the arrow direction around a shaft 2. The surface (circumferential surface) of the rotation driven electrophotographic photosensitive member 1 is uniformly charged to a predetermined positive or negative potential by a charging unit 3 (primary charging unit: charging roller, etc.). Subsequently, the surface receives exposure light (image exposure light) 4 from an exposure unit (not illustrated in drawing) such as a slit exposure unit and a laser beam scanning exposure unit. An electrostatic latent image corresponding to the target image is thus sequentially formed on the surface of the electrophotographic photosensitive member 1.

The electrostatic latent image formed on the surface of the electrophotographic photosensitive member 1 is then developed with toner contained in the developer of a developing unit 5 so as to form a toner image. Subsequently, the toner image formed and supported on the surface of the electrophotographic photosensitive member 1 is sequentially transferred to a transfer material P (e.g. paper) by transfer bias from a transfer unit 6 (e.g. transfer roller). The transfer material P is taken out from a transfer material feed unit (not illustrated in drawing) synchronously with the rotation of the electrophotographic photosensitive member 1 and fed to between the electrophotographic photosensitive member 1 and the transfer unit 6.

The transfer material P with the toner image transferred thereon is separated from the surface of the electrophotographic photosensitive member 1, introduced into a fixing unit 8 to be subjected to image fixation, and fed out from the apparatus as an image formation material (print or copy).

The surface of the electrophotographic photosensitive member 1 after transfer of toner image is subjected to removal of residual toner by a cleaning unit (cleaning blade) 7 so as to be cleaned. Subsequently, the surface is subjected to a charge elimination treatment with pre-exposure light 11 from a pre-exposure unit (not illustrated in drawing) and then repeatedly used for image formation. As illustrated in FIG. 2, in the case of the charging unit 3 of a contact type using a charging roller or the like, the pre-exposure is not necessarily required.

At least two selected from the components such as the electrophotographic photosensitive member 1, the charging unit 3, the developing unit 5, the transferring unit 6 and the cleaning unit 7 may be accommodated in a container so as to be integrally combined as a process cartridge. The process cartridge may be configured to be detachably attachable to the main body of an electrophotographic apparatus such as a copier and a laser beam printer. In FIG. 2, the electrophotographic photosensitive member 1, the charging unit 3, the developing unit 5 and the cleaning unit 7 are integrally supported in a process cartridge 9, which is detachably detachable to the main body of the electrophotographic apparatus with use of a guide unit 10 such as a rail of the main body of the electrophotographic apparatus.

EXAMPLES

With reference to Examples, the present invention is described in more detail as follows. In Examples, "parts" means "parts by mass".

Example 1

An aluminum cylinder (JIS-A 3003, aluminum alloy) with a length of 260.5 mm and a diameter of 30 mm was used as a support (conductive support).

<Conductive Layer>

Subsequently, 214 parts of titanium oxide ($TiO_2$) particles coated with oxygen-deficient tin oxide ($SnO_2$), 132 parts of a phenol resin (monomer/oligomer of phenol resin), (product name: PLYOPHEN J-325, manufactured by DIC Corporation, resin solid content: 60 mass %) as binder material, and 98 parts of 1-methoxy-2-propanol as solvent were fed into a sand mill containing 450 parts of glass beads having a diameter of 0.8 mm and subjected to dispersion treatment under conditions with a rotational speed of 2000 rpm, a dispersion treatment time of 4.5 hours, and a preset temperature of cooling water of 18° C., so that a dispersion liquid was obtained.

The glass beads were removed from the dispersion liquid with a mesh (sieve opening: 150 μm). Silicone resin particles as surface roughness imparting material (product name: TOSPEARL 120, manufactured by Momentive Performance Materials Inc., average particle diameter: 2 μm) were added to the dispersion liquid so as to have a content of 10 mass % relative to the total mass of the metal oxide particles and the binder material in the dispersion liquid after removal of the glass beads. Further, a silicone oil as levelling agent (product name: SH28PA, manufactured by Dow Corning Toray Co., Ltd.) was added to the dispersion liquid so as to have a content of 0.01 mass % relative to the total mass of the metal oxide particles and the binder material in the dispersion liquid, and the mixture was agitated to prepare a coating liquid for forming a conductive layer. The coating liquid for forming a conductive layer was applied onto the support by immersion coating, and the resulting coating film was dried at 150° C. for 30 minutes for thermosetting. Consequently, a conductive layer No. 1 having a film thickness of 30 μm was formed.

<Undercoat Layer>

In a mixed solvent of 48 parts of 1-methoxy-2-propanol and 48 parts of tetrahydrofuran, 4.6 parts of a compound represented by A101 and 8.6 parts of a blocked isocyanate compound (product name: SBN-70D, manufactured by Asahi Kasei Chemicals Corporation) were dissolved. Into the mixture, 0.3 parts of silica particles having an average primary particle diameter of 15 nm (product name: RX200, manufactured by Nippon Aerosil Co., Ltd.) was added as an additive. Glass beads having a diameter of 0.8 mm were added to the liquid and the mixture was agitated with a paint shaker for 3 hours, so that a coating liquid for forming an undercoat layer was prepared.

The coating liquid for forming an undercoat layer was applied onto the conductive layer by immersion coating, and the resulting coating film was heated at 170° C. for 20 minutes for hardening (polymerization). Consequently an undercoat layer 1 having a film thickness of 0.7 μm was formed. The film thickness and the composition of the undercoat layers are described in Table 13.

Further, through the observation of the cross section of the film after film formation with a transmission electron microscope, the dispersed state of silica particles having a particle diameter of about 15 nm was confirmed.

<Charge Generation Layer>

Subsequently, a hydroxygallium phthalocyanine crystal (charge generation material) with a crystal form having peaks at Bragg angles)(2θ±0.2° of 7.5°, 9.9°, 12.5°, 16.3°, 18.6°, 25.1° and 28.3° in CuKα characteristic X-ray diffraction was prepared. In a sand mill containing glass beads having a diameter of 1 mm, 10 parts of the hydroxygallium phthalocyanine crystal, 5 parts of polyvinyl butyral (product name: S-LEC BX-1, manufactured by Sekisui Chemical Co., Ltd.) and 250 parts of cyclohexanone were fed and subjected to dispersion treatment for 2 hours. Subsequently, 250 parts of ethyl acetate was added to the resulting dispersion to prepare a coating liquid for forming a charge generation layer.

The coating liquid for forming a charge generation layer was applied on the undercoat layer by immersion coating, and the resulting coating film was dried at 95° C. for 10 minutes so as to form a charge generation layer having a film thickness of 0.17 μm.

<Charge Transporting Layer>

Subsequently, 8 parts of an amine compound (hole transporting material) represented by the following structural formula (3)

(3)

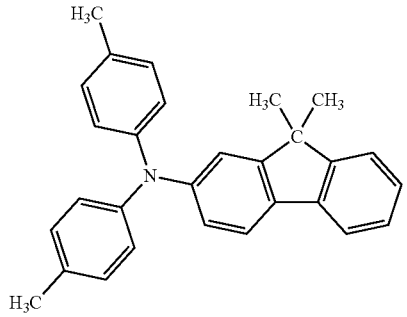

and 10 parts of a polyester resin (P1) with a weight average molecular weight (Mw) of 100,000, having repeating structural units represented by the following formulas (4) and (5) with a molar ratio of 5/5

(4)

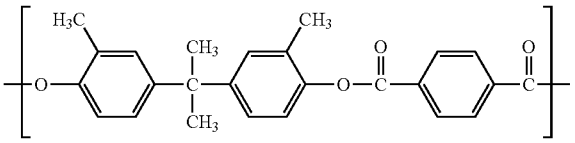

(5)

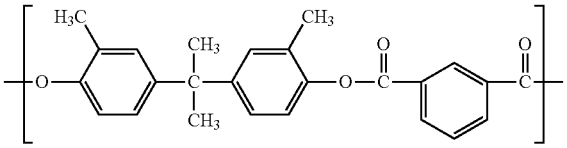

were dissolved in a mixed solvent of 40 parts of dimethoxymethane and 60 parts of chlorobenzene, so that a coating liquid for forming a hole transporting layer was prepared.

The coating liquid for forming a hole transporting layer was applied on the charge generation layer by immersion coating, and the resulting coating film was dried at 120° C. for 40 minutes. Consequently a hole transporting layer having a film thickness of 15 μm was formed.

The electrophotographic photosensitive member thus prepared was subjected to potential evaluation under an environment at normal temperature and normal humidity (23° C./50% RH). The results are described in Table 13.

(Sensitivity and Image Evaluation)

The evaluation of sensitivity was determined by the bright part potential when irradiated with the same light intensity. The sensitivity can be evaluated to be high for a low bright part potential, and to be low for a high bright part potential. For the evaluation, the electrophotographic photosensitive member was installed on an apparatus modified from a laser beam printer manufactured by Canon Inc. (product name: LBP-2510) to achieve variable exposure light intensity.

The surface potential of an electrophotographic photosensitive member was measured by removing a cartridge for development from the evaluation machine and inserting a potential measuring apparatus therein. The potential measuring apparatus includes a potential measuring probe disposed at the development position of the cartridge for development. The position of the potential measuring probe relative to the electrophotographic photosensitive member was set at the center in the axial direction of the drum.

Charging was performed to have a dark part potential (Vd) of −500 V, and the light intensity was set at 0.3 μJ/cm$^2$. As a result, the measured bright part potential (V1) was −165 V.

In Table 13, "sensitivity rank" is also described as a simple index for the sensitivity corresponding to the magnitude of the bright part potential. In the range of A to H, the sensitivity is better in alphabetical order. It was determined that the effect of the present invention was obtained in the range of A to E. The bright part potential values corresponding to the respective ranks are as follows.

A: −110 to −120V
B: −121 to −130V
C: −131 to −145V
D: −146 to −165V
E: −166 to −175V
F: −176 to −190V
G: −191 to −200V
H: −201 to −250V

Examples 2 to 44

Using material compositions described in Table 13, photosensitive members were made in the same way as in Example 1, and the potentials were evaluated in the same way. The results are described in Table 13.

Example 45

Except that the undercoat layer was changed as follows, a photosensitive member was made in the same way as in Example 1, and the potential was evaluated in the same way. The results are described in Table 13.

In a mixed solvent of 50 parts of 1-methoxy-2-propanol and 50 parts of tetrahydrofuran, 5.0 parts of a compound represented by A118, 8.6 parts of a blocked isocyanate compound (product name: SBN-70D, manufactured by Asahi Kasei Chemicals Corporation), 0.6 parts of polyvinyl acetal (product name: KS-5, manufactured by Sekisui Chemical Co., Ltd.), and 0.15 parts of zinc(II) hexanoate (product name: ZINC(II) HEXANOATE, manufactured by Mitsuwa Chemicals Co., Ltd.) as catalyst were dissolved. To the mixture, 0.3 parts of silica particles having an average primary particle diameter of 15 nm (product name: RX200, manufactured by Nippon Aerosil Co., Ltd.) were added as additive. To the liquid, glass beads having a diameter of 0.8 mm were added to be agitated with a paint shaker for 3 hours. Consequently a coating liquid for forming an undercoat layer was prepared.

The coating liquid for forming an undercoat layer was applied on the conductive layer by immersion coating, and the resulting coating film was heated at 170° C. for 20 minutes so as to be hardened (polymerized). Consequently an undercoat layer 2 with a film thickness of 0.7 μm was formed. The film thickness and the composition of the undercoat layer are described in Table 13.

Examples 46 to 49

Using material compositions described in Table 13, photosensitive members were made in the same way as in Example 45, and the potentials were evaluated in the same way. The results are described in Table 13.

Example 50

Except that the undercoat layer was changed as follows, a photosensitive member was made in the same way as in Example 1, and the potential was evaluated in the same way. The results are described in Table 13.

In a mixed liquid of 500 parts of methanol and 250 parts of butanol, 5.4 parts of a compound represented by A101, 5 parts of a copolymerized nylon resin (product name: AMILAN CM8000, manufactured by Toray Industries, Inc.), and 5 parts of a methoxymethylated nylon resin (product name: TORESIN EF30T, manufactured by Nagase ChemteX Corporation) were dissolved. To the mixture, 0.3 parts of silica particles having an average primary particle diameter of 15 nm (product name: RX200, manufactured by Nippon Aerosil Co., Ltd.) were added as additive. To the liquid, glass beads having a diameter of 0.8 mm were added to be agitated with a paint shaker for 3 hours. Consequently a coating liquid for forming an undercoat layer was prepared. The coating liquid for forming an undercoat layer was applied on the conductive layer by immersion coating, and the resulting coating film was heated at 100° C. for 20 minutes. Consequently an undercoat layer 3 with a film thickness of 0.7 μm was formed. The film thickness and the composition of the undercoat layer are described in Table 13.

In Table 13, "nylon resin" means a composition of a combination of the resins for use in the present Example.

Examples 51 to 54

Using material compositions described in Table 13, photosensitive members were made in the same way as in Example 45, and the potentials were evaluated in the same way. The results are described in Table 13.

Example 55

Except that the resin was changed to 10 parts of a copolymerized nylon resin (product name: AMILAN CM4001, manufactured by Toray Industries, Inc.), a photosensitive member was made in the same way as in Example 50, and the potential was evaluated in the same way. The results are described in Table 13.

Examples 56 and 57

Using material compositions described in Table 13, photosensitive members were made in the same way as in Example 55, and the potentials were evaluated in the same way. The results are described in Table 13.

Example 58

Except that the conductive layer was changed as follows, a photosensitive member was made in the same way as in Example 45, and the potential was evaluated in the same way. The results are described in Table 13.

In a sand mill containing 450 parts of glass beads having a diameter of 0.8 mm, 207 parts of titanium oxide ($TiO_2$) particles coated with tin oxide ($SnO_2$) doped with phosphorus (P) as conductive particles, 144 parts of a phenol resin (product name: PLYOPHEN J-325) as binder material, and 98 parts of 1-methoxy-2-propanol as solvent were fed, and subjected to dispersion treatment under conditions with a rotational speed of 2000 rpm, a dispersion treatment time of 4.5 hours, and a preset temperature of cooling water of 18° C., so that a dispersion liquid was obtained.

The glass beads were removed from the dispersion liquid with a mesh (sieve opening: 150 μm). Silicone resin particles (product name: TOSPEARL 120) were added to the dispersion liquid so as to have a content of 15 mass % relative to the total mass of the metal oxide particles and the binder material in the dispersion liquid after removal of the glass beads. Further, a silicone oil (product name: SH28PA) was added to the dispersion liquid so as to have a content of 0.01 mass % relative to the total mass of the metal oxide particles and the binder material in the dispersion liquid, and the mixture was agitated to prepare a coating liquid for forming a conductive layer. The coating liquid for forming a conductive layer was applied onto the support by immersion coating, and the resulting coating film was dried at 150° C. for 30 minutes for thermosetting. Consequently, a conductive layer No. 2 having a film thickness of 30 μm was formed.

Examples 59 and 60

Using material compositions described in Table 13, photosensitive members were made in the same way as in Example 58, and the potentials were evaluated in the same way. The results are described in Table 13.

Example 61

Except that the conductive layer was changed to No. 2 as described in Table 15, a photosensitive member was made in the same way as in Example 1, and the potential was evaluated in the same way. The results are described in Table 13.

Example 62

Except that the conductive layer was changed to No. 3 as described in Table 15, a photosensitive member was made in the same way as in Example 1, and the potential was evaluated in the same way. The results are described in Table 13.

Example 63

Except that the conductive layer was changed to No. 4 as described in Table 15, a photosensitive member was made in the same way as in Example 1, and the potential was evaluated in the same way. The results are described in Table 13.

Example 64

Except that the conductive layer was changed to No. 5 as described in Table 15, a photosensitive member was made in the same way as in Example 1, and the potential was evaluated in the same way. The results are described in Table 13.

Example 65

Except that the conductive layer was changed to No. 3 as described in Table 15 and the electron transporting material was changed to A101, a photosensitive member was made in the same way as in Example 45, and the potential was evaluated in the same way. The results are described in Table 13.

Example 66

Except that the conductive layer was changed to No. 4 as described in Table 15 and the electron transporting material was changed to A101, a photosensitive member was made in the same way as in Example 45, and the potential was evaluated in the same way. The results are described in Table 13.

Example 67

Except that the conductive layer was changed to No. 5 as described in Table 15 and the electron transporting material was changed to A101, a photosensitive member was made in the same way as in Example 45, and the potential was evaluated in the same way. The results are described in Table 13.

Example 68

Except that the conductive layer was changed to No. 2 as described in Table 15, a photosensitive member was made in the same way as in Example 50, and the potential was evaluated in the same way. The results are described in Table 13.

Example 69

Except that the conductive layer was changed to No. 3 as described in Table 15, a photosensitive member was made in the same way as in Example 50, and the potential was evaluated in the same way. The results are described in Table 13.

Example 70

Except that the conductive layer was changed to No. 4 as described in Table 15, a photosensitive member was made in the same way as in Example 50, and the potential was evaluated in the same way. The results are described in Table 13.

Example 71

Except that the conductive layer was changed to No. 5 as described in Table 15, a photosensitive member was made in the same way as in Example 50, and the potential was evaluated in the same way. The results are described in Table 13.

Example 72

An aluminum cylinder having a length of 260.5 mm and a diameter of 30 mm (JIS-A3003, aluminum alloy) was subjected to honing treatment and used as the support (conductive support). Further, except that the film thickness of the undercoat layer was changed to 5.2 μm, a photosensitive member was made in the same way as in Example 1, and the potential was evaluated in the same way. The results are described in Table 13.

Examples 73 to 79

Using material compositions described in Table 13, photosensitive members were made in the same way as in Example 72, and the potentials were evaluated in the same way. The results are described in Table 13.

TABLE 13

| Example No. | Silica particles: Type of silica | Silica particles: Hydrophobicity (%) | Silica particles: Particle diameter (nm) | Silica particles: Quantity (parts) | Electron transporting material: Type of electron transporting material | Electron transporting material: Quantity (parts) | Mass ratio: ETM/composition quantity (%) | Mass ratio: Silica/ETM quantity (%) | Cross-linking agent: Type | Cross-linking agent: Quantity (parts) | Resin: Type | Resin: Quantity (parts) | Film thickness (μm) | Sensitivity: Rank | Sensitivity: VI (V) |
|---|---|---|---|---|---|---|---|---|---|---|---|---|---|---|---|
| 1 | S1 | 66 | 15 | 0.3 | A101 | 4.6 | 35 | 7 | A | 8.6 | None | — | 0.7 | D | −165 |
| 2 | S1 | 66 | 15 | 0.4 | A101 | 7.0 | 45 | 6 | A | 8.6 | None | — | 0.7 | D | −147 |
| 3 | S1 | 66 | 15 | 1.1 | A101 | 18.2 | 68 | 6 | A | 8.6 | None | — | 0.7 | C | −132 |
| 4 | S1 | 66 | 15 | 0.06 | A101 | 4.6 | 35 | 1.4 | A | 8.6 | None | — | 0.7 | D | −162 |
| 5 | S1 | 66 | 15 | 0.14 | A101 | 4.6 | 35 | 3 | A | 8.6 | None | — | 0.7 | D | −164 |
| 6 | S1 | 66 | 15 | 0.60 | A101 | 4.6 | 35 | 13 | A | 8.6 | None | — | 0.7 | D | −162 |
| 7 | S1 | 66 | 15 | 0.83 | A101 | 4.6 | 35 | 18 | A | 8.6 | None | — | 0.7 | D | −161 |
| 8 | S1 | 66 | 15 | 1.34 | A101 | 4.6 | 35 | 29 | A | 8.6 | None | — | 0.7 | E | −171 |
| 9 | S2 | 63 | 42 | 0.3 | A101 | 4.6 | 35 | 7 | A | 8.6 | None | — | 0.7 | D | −155 |
| 10 | S3 | 60 | 111 | 0.3 | A101 | 4.6 | 35 | 7 | A | 8.6 | None | — | 0.7 | D | −160 |
| 11 | S4 | 64 | 315 | 0.3 | A101 | 4.6 | 35 | 7 | A | 8.6 | None | — | 0.7 | D | −158 |
| 12 | S5 | 66 | 1010 | 0.3 | A101 | 4.6 | 35 | 7 | A | 8.6 | None | — | 0.7 | D | −159 |
| 13 | S6 | 0 | 104 | 0.3 | A101 | 4.6 | 35 | 7 | A | 8.6 | None | — | 0.7 | C | −132 |
| 14 | S7 | 35 | 16 | 0.3 | A101 | 4.6 | 35 | 7 | A | 8.6 | None | — | 0.7 | C | −137 |
| 15 | S8 | 42 | 44 | 0.3 | A101 | 4.6 | 35 | 7 | A | 8.6 | None | — | 0.7 | C | −135 |
| 16 | S9 | S1 | 16 | 0.3 | A101 | 4.6 | 35 | 7 | A | 8.6 | None | — | 0.7 | D | −147 |
| 17 | S10 | 74 | 18 | 0.3 | A101 | 4.6 | 35 | 7 | A | 8.6 | None | — | 0.7 | D | −160 |
| 18 | S1 | 66 | 15 | 0.3 | A102 | 4.6 | 35 | 7 | A | 8.6 | None | — | 0.7 | D | −166 |
| 19 | S1 | 66 | 15 | 0.3 | A103 | 4.6 | 35 | 7 | A | 8.6 | None | — | 0.7 | D | −162 |
| 20 | S1 | 66 | 15 | 0.3 | A104 | 4.6 | 35 | 7 | A | 8.6 | None | — | 0.7 | D | −168 |
| 21 | S1 | 66 | 15 | 0.3 | A105 | 4.6 | 35 | 7 | A | 8.6 | None | — | 0.7 | D | −147 |
| 22 | S1 | 66 | 15 | 0.3 | A108 | 4.6 | 35 | 7 | A | 8.6 | None | — | 0.7 | C | −140 |
| 23 | S1 | 66 | 15 | 0.3 | A109 | 4.6 | 35 | 7 | A | 8.6 | None | — | 0.7 | C | −139 |
| 24 | S1 | 66 | 15 | 0.3 | A111 | 4.6 | 35 | 7 | A | 8.6 | None | — | 0.7 | C | −140 |
| 25 | S1 | 66 | 15 | 0.3 | A112 | 4.6 | 35 | 7 | A | 8.6 | None | — | 0.7 | C | −135 |
| 26 | S1 | 66 | 15 | 0.3 | A113 | 4.6 | 35 | 7 | A | 8.6 | None | — | 0.7 | B | −124 |
| 27 | S1 | 66 | 15 | 0.3 | A116 | 4.6 | 35 | 7 | A | 8.6 | None | — | 0.7 | B | −125 |
| 28 | S1 | 66 | 15 | 0.3 | A118 | 4.6 | 35 | 7 | A | 8.6 | None | — | 0.7 | B | −124 |
| 29 | S1 | 66 | 15 | 0.3 | A201 | 4.6 | 35 | 7 | A | 8.6 | None | — | 0.7 | C | −145 |
| 30 | S1 | 66 | 15 | 0.3 | A301 | 4.6 | 35 | 7 | A | 8.6 | None | — | 0.7 | C | −139 |
| 31 | S1 | 66 | 15 | 0.3 | A401 | 4.6 | 35 | 7 | A | 8.6 | None | — | 0.7 | C | −142 |
| 32 | S1 | 66 | 15 | 0.3 | A501 | 4.6 | 35 | 7 | A | 8.6 | None | — | 0.7 | C | −144 |
| 33 | S1 | 66 | 15 | 0.3 | A601 | 4.6 | 35 | 7 | A | 8.6 | None | — | 0.7 | C | −140 |
| 34 | S1 | 66 | 15 | 0.3 | A701 | 4.6 | 35 | 7 | A | 8.6 | None | — | 0.7 | C | −138 |
| 35 | S1 | 66 | 15 | 0.3 | A801 | 4.6 | 35 | 7 | A | 8.6 | None | — | 0.7 | C | −142 |
| 36 | S1 | 66 | 15 | 0.3 | A901 | 4.6 | 35 | 7 | A | 8.6 | None | — | 0.7 | E | −167 |
| 37 | S1 | 66 | 15 | 0.3 | A1001 | 4.6 | 35 | 7 | A | 8.6 | None | — | 0.7 | E | −166 |
| 38 | S1 | 66 | 15 | 0.3 | A1101 | 4.6 | 35 | 7 | A | 8.6 | None | — | 0.7 | E | −169 |
| 39 | S7 | 35 | 16 | 0.3 | A105 | 4.6 | 35 | 7 | A | 8.6 | None | — | 0.7 | C | −139 |
| 40 | S7 | 35 | 16 | 0.3 | A102 | 4.6 | 35 | 7 | A | 8.6 | None | — | 0.7 | D | −147 |
| 41 | S7 | 35 | 16 | 0.3 | A109 | 4.6 | 35 | 7 | A | 8.6 | None | — | 0.7 | B | −124 |
| 42 | S7 | 35 | 16 | 0.3 | A118 | 4.6 | 35 | 7 | A | 8.6 | None | — | 0.7 | A | −118 |

TABLE 13-continued

| Example No. | Silica particles: Type of silica | Silica particles: Hydrophobicity (%) | Silica particles: Particle diameter (nm) | Silica particles: Quantity (parts) | Electron transporting material: Type of electron transporting material | Electron transporting material: Quantity (parts) | Mass ratio: ETM/composition quantity (%) | Mass ratio: Silica/ETM quantity (%) | Cross-linking agent: Type | Cross-linking agent: Quantity (parts) | Resin: Type | Resin: Quantity (parts) | Film thickness (μm) | Sensitivity: Rank | Sensitivity: VI (V) |
|---|---|---|---|---|---|---|---|---|---|---|---|---|---|---|---|
| 43 | S1 | 66 | 15 | 0.3 | A101 | 4.7 | 35 | 6 | B | 8.6 | None | — | 0.7 | E | −167 |
| 44 | S1 | 66 | 15 | 0.3 | A101 | 4.7 | 35 | 6 | C | 8.6 | None | — | 0.7 | E | −170 |
| 45 | S1 | 66 | 15 | 0.3 | A118 | 5.0 | 35 | 6 | A | 8.6 | KS-5 | 0.6 | 0.7 | A | −119 |
| 46 | S1 | 66 | 15 | 0.5 | A118 | 7.5 | 45 | 6 | A | 8.6 | KS-5 | 0.6 | 0.7 | A | −115 |
| 47 | S1 | 66 | 15 | 1.2 | A118 | 19.5 | 68 | 6 | A | 8.6 | KS-5 | 0.6 | 0.7 | A | −110 |
| 48 | S7 | 35 | 15 | 0.3 | A118 | 5.0 | 35 | 6 | A | 8.6 | KS-5 | 0.6 | 0.7 | A | −112 |
| 49 | S1 | 66 | 15 | 0.3 | A101 | 5.0 | 35 | 6 | A | 8.6 | BM-1 | 0.6 | 0.7 | E | −129 |
| 50 | S1 | 66 | 12 | 0.3 | A101 | 5.4 | 35 | 6 | None | — | Nylon resin | 10 | 0.7 | E | −172 |
| 51 | S7 | 35 | 16 | 0.3 | A101 | 5.4 | 35 | 6 | None | — | Nylon resin | 10 | 0.7 | D | −150 |
| 52 | S1 | 66 | 12 | 0.3 | A109 | 5.4 | 35 | 6 | None | — | Nylon resin | 10 | 0.7 | D | −152 |
| 53 | S7 | 35 | 16 | 0.3 | A109 | 5.4 | 35 | 6 | None | — | Nylon resin | 10 | 0.7 | C | −135 |
| 54 | S7 | 35 | 16 | 0.3 | A118 | 5.4 | 35 | 6 | None | — | Nylon resin | 10 | 0.7 | B | −127 |
| 55 | S1 | 66 | 12 | 0.3 | A101 | 5.4 | 35 | 6 | None | — | CM-4001 | 10 | 0.7 | E | −175 |
| 56 | S7 | 35 | 16 | 0.3 | A101 | 5.4 | 35 | 6 | None | — | CM-4001 | 10 | 0.7 | D | −165 |
| 57 | S7 | 35 | 16 | 0.3 | A118 | 5.4 | 35 | 6 | None | — | CM-4001 | 10 | 0.7 | B | −129 |
| 58 | S1 | 66 | 15 | 0.3 | A101 | 5.0 | 35 | 6 | A | 8.6 | KS-5 | 0.6 | 0.7 | D | −162 |
| 59 | S7 | 35 | 16 | 0.3 | A101 | 5.0 | 35 | 6 | A | 8.6 | KS-5 | 0.6 | 0.7 | C | −138 |
| 60 | S7 | 35 | 16 | 0.3 | A118 | 5.0 | 35 | 6 | A | 8.6 | KS-5 | 0.6 | 0.7 | B | −122 |
| 61 | S1 | 66 | 15 | 0.3 | A101 | 4.6 | 35 | 7 | A | 8.6 | None | — | 0.7 | D | −166 |
| 62 | S1 | 66 | 15 | 0.3 | A101 | 4.6 | 35 | 7 | A | 8.6 | None | — | 0.7 | E | −178 |
| 63 | S1 | 66 | 15 | 0.3 | A101 | 4.6 | 35 | 7 | A | 8.6 | None | — | 0.7 | E | −180 |
| 64 | S1 | 66 | 15 | 0.3 | A101 | 4.6 | 35 | 7 | A | 8.6 | None | — | 0.7 | E | −177 |
| 65 | S1 | 66 | 15 | 0.3 | A101 | 5.0 | 35 | 6 | A | 8.6 | KS-5 | 0.6 | 0.7 | E | −172 |
| 66 | S1 | 66 | 15 | 0.3 | A101 | 5.0 | 35 | 6 | A | 8.6 | KS-5 | 0.6 | 0.7 | E | −175 |
| 67 | S1 | 66 | 15 | 0.3 | A101 | 5.0 | 35 | 6 | A | 8.6 | KS-5 | 0.6 | 0.7 | E | −169 |
| 68 | S1 | 66 | 15 | 0.3 | A101 | 5.4 | 35 | 6 | None | — | Nylon resin | 10 | 0.7 | E | −170 |
| 69 | S1 | 66 | 15 | 0.3 | A101 | 5.4 | 35 | 6 | None | — | Nylon resin | 10 | 0.7 | E | −173 |
| 70 | S1 | 66 | 15 | 0.3 | A101 | 5.4 | 35 | 6 | None | — | Nylon resin | 10 | 0.7 | E | −175 |
| 71 | S1 | 66 | 15 | 0.3 | A101 | 5.4 | 35 | 6 | None | — | Nylon resin | 10 | 0.7 | E | −175 |
| 72 | S1 | 66 | 12 | 0.6 | A101 | 10.0 | 54 | 6 | A | 8.6 | None | — | 5.2 | E | −172 |
| 73 | S7 | 35 | 16 | 0.6 | A101 | 10.0 | 54 | 6 | A | 8.6 | None | — | 5.3 | D | −164 |
| 74 | S7 | 35 | 16 | 0.6 | A109 | 10.0 | 54 | 6 | A | 8.6 | None | — | 5.3 | C | −140 |
| 75 | S7 | 35 | 16 | 0.6 | A118 | 10.0 | 54 | 6 | A | 8.6 | None | — | 5.3 | B | −130 |
| 76 | S1 | 66 | 12 | 0.7 | A101 | 11.7 | 54 | 6 | None | — | Nylon resin | 10 | 5.1 | E | −175 |
| 77 | S7 | 35 | 16 | 0.7 | A101 | 11.7 | 54 | 6 | None | — | Nylon resin | 10 | 5.1 | D | −165 |
| 78 | S7 | 35 | 16 | 0.7 | A109 | 11.7 | 54 | 6 | None | — | Nylon resin | 10 | 5.1 | C | −144 |
| 79 | S7 | 35 | 16 | 0.7 | A118 | 11.7 | 54 | 6 | None | — | Nylon resin | 10 | 5.1 | B | −132 |

In Table 13, S1 to S10 represent different types of silica particles. The silica particles are described in detail in the following Table 14.

TABLE 14

| Silica | Product name | Manufacturer | Particle diameter (nm) | Hydrophobicity (%) |
|---|---|---|---|---|
| | Details of silica | | | |
| S1 | RX200 | Nippon Aerosil Co., Ltd. | 15 | 66 |
| S2 | RX50 | Nippon Aerosil Co., Ltd. | 42 | 63 |
| S3 | CTS-100A | Shin-Etsu Chemical Co., Ltd. | 111 | 60 |
| S4 | KE-P30 | Nippon Shokubai Co., Ltd. | 315 | 64 |
| S5 | KE-P150 | Nippon Shokubai Co., Ltd. | 1010 | 66 |
| S6 | Scqias0.1 | Sakai Chemical Industry Co., Ltd. | 104 | 0 |
| S7 | Aerosil200 | Nippon Aerosil Co., Ltd. | 16 | 35 |
| S8 | OX50 | Nippon Aerosil Co., Ltd. | 44 | 42 |
| S9 | R974 | Nippon Aerosil Co., Ltd. | 16 | 51 |
| S10 | RY200S | Nippon Aerosil Co., Ltd. | 18 | 74 |

In Table 13, the cross-linking agent A is SBN-70D (manufactured by Asahi Kasei Chemicals Corporation). SBN-70D is a blocked isocyanate compound having a skeleton represented by (B1), with (H5) as blocking group. The cross-linking agent B is L-145-60 (manufactured by DIC Corporation). L-145-60 is a melamine compound having a skeleton represented by (C2). The cross-linking agent C is BL-3175 (manufactured by Sumika Beyer Urethane Co., Ltd.). BL-3175 is a blocked isocyanate compound having a skeleton represented by (B1), with (H1) as blocking group. In Table 13, KS-5 is a polyvinyl acetal resin having a structure (E-1) manufactured by Sekisui Chemical Co., Ltd. BM-1 is a polyvinyl butyral resin having a structure (E-1) manufactured by Sekisui Chemical Co., Ltd. CM-4001 represents a polyamide resin having a structure (E-5) manufactured by Toray Industries, Inc.

The compositions for the respective conductive layers manufactured in the Examples are described in the following Table 15.

TABLE 15

| Conductive layer No. | Cross-linking agent | Resin | Metal oxide | Other additives |
|---|---|---|---|---|
| | Composition of conductive layer | | | |
| 1 | None | J-325 | $SnO_2$-coated $TiO_2$ | |
| 2 | None | J-325 | P-doped $SnO_2$-coated $TiO_2$ | |
| 3 | BL-3175 | S-LEC BM-1 | ZnO | Alizarin, Teflon resin particles |

TABLE 15-continued

| Conductive layer No. | Cross-linking agent | Resin | Metal oxide | Other additives |
|---|---|---|---|---|
| | Composition of conductive layer | | | |
| 4 | L-145-60 | M-6401-50 | $TiO_2$ | |
| 5 | WB-920 | BURNOCK WE-300 | $TiO_2$ surface treated with $Al_2O_3$ & $ZrO_2$ | |

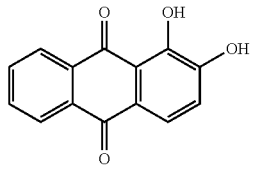

Alizarin (1,2-dihydroxyanthraquinone)

Comparative Examples 1 to 4

Except that the electron transporting material and silica particles were added in amounts as described in Table 16 to the coating liquid for forming an undercoat layer for use in Example 1, electrophotographic photosensitive members were made in the same way as in Example 1, and the potentials were evaluated in the same way. The results are described in Table 16.

Comparative Examples 5 to 7

Except that the conductive layers were changed to No. 2 to No. 5 as described in Table 14, photosensitive members were made in the same way as in Comparative Example 3, and the potentials were evaluated in the same way. The results are described in Table 15.

Comparative Examples 8 and 9

Except that the electron transporting materials and silica particles were added in amounts as described in Table 16 to the coating liquid for forming an undercoat layer in Example 45, electrophotographic photosensitive members were made in the same way as in Example 45, and the potentials were evaluated in the same way. The results are described in Table 16.

Comparative Example 10

Except that no silica particles were added to the coating liquid for forming an undercoat layer in Example 73, an electrophotographic photosensitive member was made in the same way as in Example 73, and the potentials were evaluated in the same way. The results are described in Table 16.

TABLE 16

| Comparative Example No. | Silica particles: Type of silica | Silica particles: Hydrophobicity (%) | Silica particles: Particle diameter (nm) | Silica particles: Quantity (parts) | Electron transporting material: Type of electron transporting material | Electron transporting material: Quantity (parts) | Mass ratio: ETM/composition quantity (%) | Mass ratio: Silica/ETM quantity (%) |
|---|---|---|---|---|---|---|---|---|
| 1 | S1 | 66 | 15 | 0.01 | A101 | 4.6 | 35 | 0.2 |
| 2 | S1 | 66 | 15 | 1.85 | A101 | 4.6 | 35 | 40 |
| 3 | None | | | | A101 | 4.6 | 35 | 0 |

TABLE 16-continued

| | | | | | | | | |
|---|---|---|---|---|---|---|---|---|
| 4 | S1 | 66 | 15 | 0.3 | | | None | |
| 5 | | None | | | A101 | 4.6 | 35 | — |
| 6 | | None | | | A101 | 4.6 | 35 | — |
| 7 | | None | | | A101 | 4.6 | 35 | — |
| 8 | | None | | | A101 | 5.4 | 35 | — |
| 9 | S1 | 66 | 15 | 0.3 | | | None | |
| 10 | | None | | | A101 | 4.6 | 35 | 0 |

| Comparative | Cross-linking agent | | Resin | | Film | Sensitivity | |
|---|---|---|---|---|---|---|---|
| Example No. | Type | Quantity (parts) | Type | Quantity (parts) | thickness (μm) | Rank | VI (V) |
| 1 | A | 8.6 | None | — | 0.7 | F | −205 |
| 2 | A | 8.6 | None | — | 0.7 | G | −207 |
| 3 | A | 8.6 | None | — | 0.7 | G | −211 |
| 4 | A | 8.6 | None | — | 0.7 | H | −245 |
| 5 | A | 8.6 | None | — | 0.7 | H | −212 |
| 6 | A | 8.6 | None | — | 0.7 | H | −218 |
| 7 | A | 8.6 | None | — | 0.7 | H | −215 |
| 8 | None | | Nylon resin | 10 | 0.7 | H | −224 |
| 9 | None | | Nylon resin | 10 | 0.7 | H | −268 |
| 10 | A | 8.6 | None | — | 5.3 | H | −221 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-012468, filed Jan. 26, 2015, which is hereby incorporated by reference herein in its entirety.

What is claimed is:

1. An electrophotographic photosensitive member comprising:

a support, an undercoat layer, a charge generation layer adjacent to the undercoat layer, and a hole transporting layer disposed in this order, the undercoat layer containing (1) silica particles and a polymerized product of a composition comprising an electron transporting material having a polar group selected from the group consisting of a hydroxy group, a thiol group, an amino group, a carboxy group and a methoxy group, with a content of the electron transporting material in the composition being 30 to 70 mass % relative to the total mass of the composition; or (2) silica particles and an electron transporting material comprising a polar group selected from the group consisting of a hydroxy group, a thiol group, an amino group, a carboxy group and a methoxy group, and a binder resin, with a content of the electron transporting material in the undercoat layer being 30 to 70 mass % relative to the total mass of the electron transporting material and the binder resin, wherein a content of the silica particles in the undercoat layer is 1 to 30 mass % relative to the total mass of the electron transporting material.

2. The electrophotographic photosensitive member according to claim 1, wherein the silica particles have an average primary particle diameter of 10 to 2000 nm.

3. The electrophotographic photosensitive member according to claim 1, wherein the silica particles have a hydrophobicity of 40% or less.

4. The electrophotographic photosensitive member according to claim 1, wherein the electron transporting material comprises at least 2 groups represented by formula (A):

$$-(\alpha^1)_l(\beta)_m-\gamma \quad (A)$$

wherein at least one of "$\alpha^1$", "β" and "γ" is a group having the polar group, and l and m each independently represent 0 or 1, with a sum of l and m of 0 to 2;

"$\alpha^1$" represents a substituted or unsubstituted alkylene group having a main chain with 1 to 12 atoms, a group having a main chain with 1 to 12 atoms derived by replacing a methylene group in the main chain of a substituted or unsubstituted alkylene group with an oxygen atom, a group having a main chain with 1 to 12 atoms derived by replacing a methylene group in a main chain of a substituted or unsubstituted alkylene group with a sulfur atom, or a group having a main chain with 1 to 12 atoms derived by replacing a methylene group in a main chain of a substituted or unsubstituted alkylene group with $NR^1$;

a substituent of the substituted alkylene group is an alkyl group with 1 to 6 carbon atoms, a benzyl group, an alkoxycarbonyl group, or a phenyl group;

$R^1$ represents a hydrogen atom or an alkyl group;

"β" represents a substituted or unsubstituted phenylene group, a substituted or unsubstituted cycloalkylene group, or a substituted or unsubstituted cycloalkylidene group;

a substituent of the substituted phenylene group, a substituent of the substituted cycloalkylene group, or a substituent of the substituted cycloalkylidene group is an alkyl group with 1 to 6 carbon atoms, a nitro group, a halogen group, or an alkoxy group;

"γ" represents a hydrogen atom, a substituted or unsubstituted alkyl group having a main chain with 1 to 6 atoms, a group having a main chain with 1 to 6 atoms derived by replacing the methylene group in a main chain of a substituted or unsubstituted alkyl group with an oxygen atom, a group having a main chain with 1 to 6 atoms derived by replacing a methylene group in a main chain of a substituted or unsubstituted alkyl group with a sulfur atom, or a group having a main chain with 1 to 6 atoms derived by replacing a methylene group in a main chain of a substituted or unsubstituted alkyl group with $NR^2$;

a substituent of the substituted alkyl group is an alkyl group having 1 to 6 carbon atoms or an alkoxycarbonyl group; and $R^2$ represents a hydrogen atom or an alkyl group.

5. The electrophotographic photosensitive member according to claim 1, wherein the electron transporting material comprises each of a group represented by formula (A1) and a group represented by formula (A2):

$$-\alpha^2 \quad \text{(A1)}$$

$$-(\beta)_m-\gamma \quad \text{(A2)}$$

wherein "$\alpha^2$" and "$\gamma$" are groups having the polar group;

"$\alpha^2$" represents a substituted or unsubstituted alkyl group having a main chain with 2 to 12 atoms, a group having a main chain with 2 to 12 atoms derived by replacing a methylene group in a main chain of a substituted or unsubstituted alkyl group with an oxygen atom, a group having a main chain with 2 to 12 atoms derived by replacing a methylene group in a main chain of a substituted or unsubstituted alkyl group with a sulfur atom, or a group having a main chain with 1 to 12 atoms derived by replacing a methylene group in a main chain of a substituted or unsubstituted alkyl group with $NR^3$;

a substituent of the substituted alkyl group is an alkyl group having 1 to 6 carbons or an alkoxycarbonyl group, except for the case of having two or more of the substituents on one carbon atom in the main chain of the alkyl group;

$R^3$ represents a hydrogen atom or an alkyl group;

"$\beta$" represents a substituted or unsubstituted phenylene group, a substituted or unsubstituted cycloalkylene group, or a substituted or unsubstituted cycloalkylidene group; and a substituent of the substituted phenylene group, a substituent of the substituted cycloalkylene group, or a substituent of the cycloalkylidene group is an alkyl group having 1 to 6 carbons, a nitro group, a halogen group, or an alkoxy group, and m is 0 or 1, wherein in the case of m=1, "$\gamma$" represents a hydrogen atom, a substituted or unsubstituted alkyl group having a main chain with 1 to 6 atoms, a group having a main chain with 1 to 6 atoms derived by replacing a methylene group in a main chain of a substituted or unsubstituted alkyl group with an oxygen atom, a group having a main chain with 1 to 6 atoms derived by replacing a methylene group in a main chain of a substituted or unsubstituted alkyl group with a sulfur atom, or a group having a main chain with 1 to 6 atoms derived by replacing a methylene group in a main chain of a substituted or unsubstituted alkyl group with $NR^2$; a substituent of the substituted alkyl group is an alkyl group having 1 to 6 carbons or an alkoxycarbonyl group; and $R^2$ represents a hydrogen atom or an alkyl group, and in the case of m=0, "$\gamma$" represents a substituted alkyl group having a main chain with 1 to 6 atoms, a group having a main chain with 1 to 6 atoms derived by replacing a methylene group in a main chain of a substituted alkyl group with an oxygen atom, a group having a main chain with 1 to 6 atoms derived by replacing a methylene group in a main chain of a substituted alkyl group with a sulfur atom, or a group having a main chain with 1 to 6 atoms derived by replacing a methylene group in a main chain of a substituted alkyl group with $NR^2$; and the substituted alkylene group has at least 2 substituents on one carbon atom in the main chain of the alkyl group, and the substituent is an alkyl group having 1 to 6 carbons or an alkoxycarbonyl group.

6. A method for manufacturing an electrophotographic photosensitive member having a support, an undercoat layer, a charge generation layer adjacent to the undercoat layer, and a hole transporting layer disposed in this order, comprising:

forming a coating film from a coating liquid for forming an undercoat layer containing (1) silica particles and a composition comprising an electron transporting material having a polar group selected from the group consisting of a hydroxy group, a thiol group, an amino group, a carboxy group and a methoxy group, wherein a content of the electron transporting material in the composition is 30 to 70 mass % relative to the total mass of the composition and a content of the silica particles in the coating liquid for forming an undercoat layer is 1 to 30 mass % relative to the total mass of the electron transporting material; or (2) silica particles and an electron transporting material comprising a polar group selected from the group consisting of a hydroxy group, a thiol group, an amino group, a carboxy group and a methoxy group, and a binder resin, wherein a content of the electron transporting material in the coating liquid for forming an undercoat layer is 30 to 70 mass % relative to the total mass of the electron transporting material and the binder resin and a content of the silica particles in the coating liquid for forming an undercoat layer is 1 to 30 mass % relative to the total mass of the electron transporting material; and forming the undercoat layer by heating and drying the coating film.

7. The method for manufacturing an electrophotographic photosensitive member according to claim 6, wherein the silica particles have a hydrophobicity of 40% or less.

8. A process cartridge detachably detachable to the main body of an electrophotographic apparatus comprising:

an electrophotographic photosensitive member and at least one unit selected from the group consisting of a charging unit, a developing unit and a cleaning unit integrally supported therein, the electrophotographic photosensitive member comprising a support, an undercoat layer, a charge generation layer adjacent to the undercoat layer, and a hole transporting layer disposed in this order, the undercoat layer containing (1) silica particles and a polymerized product of a composition comprising an electron transporting material having a polar group selected from the group consisting of a hydroxy group, a thiol group, an amino group, a carboxy group and a methoxy group, with a content of the electron transporting material in the composition being 30 to 70 mass % relative to the total mass of the composition; or (2) silica particles and an electron transporting material comprising a polar group selected from the group consisting of a hydroxy group, a thiol group, an amino group, a carboxy group and a methoxy group, and a binder resin, with a content of the electron transporting material in the undercoat layer being 30 to 70 mass % relative to the total mass of the electron transporting material and the binder resin, wherein a content of the silica particles in the undercoat layer is 1 30 mass % relative to the total mass of the electron transporting material.

9. An electrophotographic apparatus comprising:

an electrophotographic photosensitive member, a charging unit, an exposure unit, a developing unit and a transferring unit, the electrophotographic photosensitive member comprising a support, an undercoat layer, a charge generation layer adjacent to the undercoat layer, and a hole transporting layer disposed in this order, the undercoat layer containing (1) silica particles and a polymerized product of a composition comprising an electron transporting material having a polar group selected from the group consisting of a hydroxy group, a thiol group, an amino group, a carboxy group and a methoxy group, with a content of the electron transporting material in the composition being 30 to 70 mass % relative to the total mass of the composition; or (2) silica particles and an electron transporting material comprising a polar group selected from the group consisting of a hydroxy group, a thiol group, an amino group, a carboxy group and a methoxy group, and a binder resin, with a content of the electron transporting material in the undercoat layer being 30 to 70 mass % relative to the total mass of the electron transporting material and the binder resin; and a content of the silica particles in the undercoat layer being 1 to 30 mass % relative to the total mass of the electron transporting material.

10. The electrophotographic photosensitive member according to claim 1, wherein the silica particles have the silanol group on its surface.

11. The electrophotographic photosensitive member according to claim 1, wherein the silica particles and the electron transporting materials are present in the vicinity of the interface with the photosensitive layer.

12. The electrophotographic photosensitive member according to claim 1, wherein the composition further comprises a cross-linking agent.

* * * * *